US007010953B2

(12) United States Patent
Stupecky

(10) Patent No.: US 7,010,953 B2
(45) Date of Patent: Mar. 14, 2006

(54) SWAGING MACHINE AND METHOD OF USE

(75) Inventor: Josef J. Stupecky, Laguna Niguel, CA (US)

(73) Assignee: Interface Associates, Inc., Laguna Niguel, CA (US)

( * ) Notice: Subject to any disclaimer, the term of this patent is extended or adjusted under 35 U.S.C. 154(b) by 115 days.

(21) Appl. No.: 10/676,495

(22) Filed: Sep. 30, 2003

(65) Prior Publication Data

US 2004/0149000 A1 Aug. 5, 2004

Related U.S. Application Data

(60) Provisional application No. 60/444,999, filed on Feb. 4, 2003.

(51) Int. Cl.
*B21D 39/04* (2006.01)

(52) U.S. Cl. ..... 72/416; 72/402; 29/283.5

(58) Field of Classification Search ..... 72/402, 72/416, 76, 318, 316; 29/283.5
See application file for complete search history.

(56) References Cited

U.S. PATENT DOCUMENTS 1,210,895 A * 1/1917 Brinkman ..... 72/69
1,894,800 A * 1/1933 Stowe ..... 72/76
2,617,319 A * 11/1952 Richards ..... 72/76
3,044,326 A * 7/1962 Ribback ..... 72/76
3,374,651 A * 3/1968 Haug ..... 72/76
3,587,287 A * 6/1971 Vacca ..... 72/402
3,645,126 A 2/1972 Kralowetz et al.
3,648,501 A * 3/1972 Kralowetz ..... 72/76
3,845,650 A * 11/1974 Romanov et al. ..... 72/310
5,609,056 A 3/1997 Seeber
6,070,446 A 6/2000 Blaimschein et al.
6,296,633 B1 10/2001 Helgerson
6,308,546 B1 10/2001 Blaimschein et al.

* cited by examiner

*Primary Examiner*—Daniel C. Crane
(74) *Attorney, Agent, or Firm*—Knobbe, Martens, Olson & Bear LLP

(57) ABSTRACT

A swaging machine is configured to substantially uniformly reduce the diameter of a tubular attachment, such as a marker band, to result in a smooth and repeatable finished part. The swaging machine comprises a feed system, an impact system, and a rotation system. A split die having a compound die cavity is provided for use in conjunction with the swaging machine to receive an impact force from the impact system and, in turn, apply a swaging force to the marker band. The rotation system rotates the impact system, including the die, about the axis of the marker band to apply swaging forces about the circumference of the marker band, while the feed system feeds the marker band through the die thereby applying swaging forces along the length of the marker band.

17 Claims, 19 Drawing Sheets

SWAGING MACHINE AND METHOD OF USE

CROSS REFERENCE TO RELATED APPLICATIONS

The current application claims priority to Provisional Patent Application having Ser. No. 60/444,999 filed Feb. 4, 2003, the entirety of which is hereby incorporated by reference.

BACKGROUND OF THE INVENTION

1. Field of the Invention

Embodiments of the present invention relate to the field of swaging marker bands and joining sleeves to hollow tubing, solid wire or a rod. More specifically, the swaging machine of the preferred embodiments applies a repeating impact to reduce the diameter of a cylindrical marker band.

2. Description of the Related Art

When using catheters, operators desire to visualize the precise location of the catheter within a patient's body. Therefore, catheters are often configured with marker bands, which are x-ray opaque indicators that allow an operator to see the specific location of the marker band through x-ray imaging. These marker bands are typically swaged onto the catheter.

Swaging is the metalworking process of tapering or reducing the diameter of a rod or tube. This is typically accomplished by forging, crimping, or hammering. Many catheters are formed of various polymers and require careful swaging of a metal band so as to not compromise the integrity of the catheter. There have been many devices constructed for this particular purpose, however, there are inherent complications that many of the prior art devices fail to address.

It is desirous for a swaged component to exhibit a fairly smooth and uniform surface. This produces a better image through typical bio-imaging techniques. Oftentimes, the swaging process will result in striations, creases, folds, and non-uniform cross sections. It can be very difficult to obtain the desired results. In addition, since many catheters are formed from a variety of polymeric materials, the inner diameter of the swaged part must be carefully controlled to prevent damage to the underlying catheter.

SUMMARY OF PREFERRED EMBODIMENTS

According to one preferred embodiment, a swaging machine is configured to swage a marker band onto a catheter and comprises a feed system comprising a motor and a clamp, the clamp slideably disposed on a rail. The motor is in driving engagement with the clamp and configured for transmitting a feeding force to the clamp. An impact system comprises a hammer and a die. The hammer is configured to deliver an impact to the die, and the die is configured to distribute the impact force as a swaging force to the marker band. In addition, a rotation system comprises a motor and is configured to rotate the impact system to distribute the swaging force about the circumference of the marker band. Moreover, the motor can be operatively coupled to a feed screw, the feed screw having a coupled end connected to the clamp and the motor can be configured to drive the feed screw and the clamp linearly. A damping coupling can optionally be provided between the feed screw and the clamp. In addition, the damping coupling can be configured to allow restricted movement of the feed screw to align itself with the motor, and in one embodiment, is formed of polyurethane tubing. According to another embodiment, the clamp comprises a first jaw and a second jaw configured for relative displacement to open and close the clamp. The clamp can be configured for symmetrical opening and closing. The clamp can further be coupled to a pneumatic cylinder having a pair of compressed air supply hoses, an internal piston, and a piston rod connected to the clamp. In one embodiment, the cylinder piston rod translates an actuation force to at least one jaw of the clamp. The clamp can be configured with a coupling interconnecting the first jaw and the second jaw to thereby translate an actuation force thereto. In one embodiment, the coupling comprises a lever having a midpoint rotatably mounted to a base and slidingly engages each of the first jaw and second jaw. According to some preferred embodiments, the hammer comprises a pneumatic cylinder having one or more delivery hoses coupled thereto, an internal piston moveable through a power stroke and a return stroke, and a piston rod extending from the piston to the exterior of the cylinder. The piston rod can carry a mass configured to deliver an impact. In some embodiments, one or more delivery hoses supply compressed air to the cylinder to drive the piston and piston rod through the power stroke. In some embodiments, the piston is caused to move through its return stroke by a biasing member, while in other embodiments, the piston is caused to move through its return stroke by a pneumatic cylinder. A rotation limiter can be supplied to limit the angular displacement of the rotation system, and in some embodiments, comprises an indicator, a sensor, and a signal output generator. The indicator can be a timing cam, in which case the sensor senses at least two states of the timing cam corresponding with the angular orientation of the timing cam, ad the signal output generator sends a signal to a control system corresponding with the state of the cam. The rotation limiter can limit angular displacement of the rotation system to 180 degrees. In other embodiments, the angular displacement is limited by a control system.

In addition to the embodiments described above, a novel method of swaging a marker band onto a catheter comprises the steps of providing a work piece comprising a catheter and a marker band positioned on the catheter; providing a die, the die having a variable volume swaging cavity formed therein; feeding the work piece into the die; impacting the die thereby varying the volume of the swaging cavity to impart a force onto the work piece; and rotating the die to impart the force around the circumference of the work piece. Embodiments may also include the step of grasping the work piece in a clamp and the clamp can be configured to move toward and away from the die. In addition, a die can be selected that is configured to swage the provided work piece. An impact can vary the volume of the swaging cavity. In one preferred embodiment, the swaging cavity has a length and gradually reduces in diameter along at least a portion of its length.

In the following description, reference is made to the accompanying drawings which form a part of this written description which show, by way of illustration, specific embodiments in which the invention can be practiced. It is to be understood that other embodiments may be utilized and structural changes may be made without departing from the scope of the present invention. Where possible, the same reference numbers will be used throughout the drawings to refer to the same or like components. Numerous specific details are set forth in order to provide a thorough understanding of the present invention; however, it should be obvious to one skilled in the art that the present invention may be practiced without the specific details or with certain alternative equivalent devices and methods to those described herein. In other instances, well-known methods, procedures, components and devices have not been described in detail so as not to unnecessarily obscure aspects of the present invention.

DETAILED DESCRIPTION OF PREFERRED EMBODIMENTS

Figure 1:
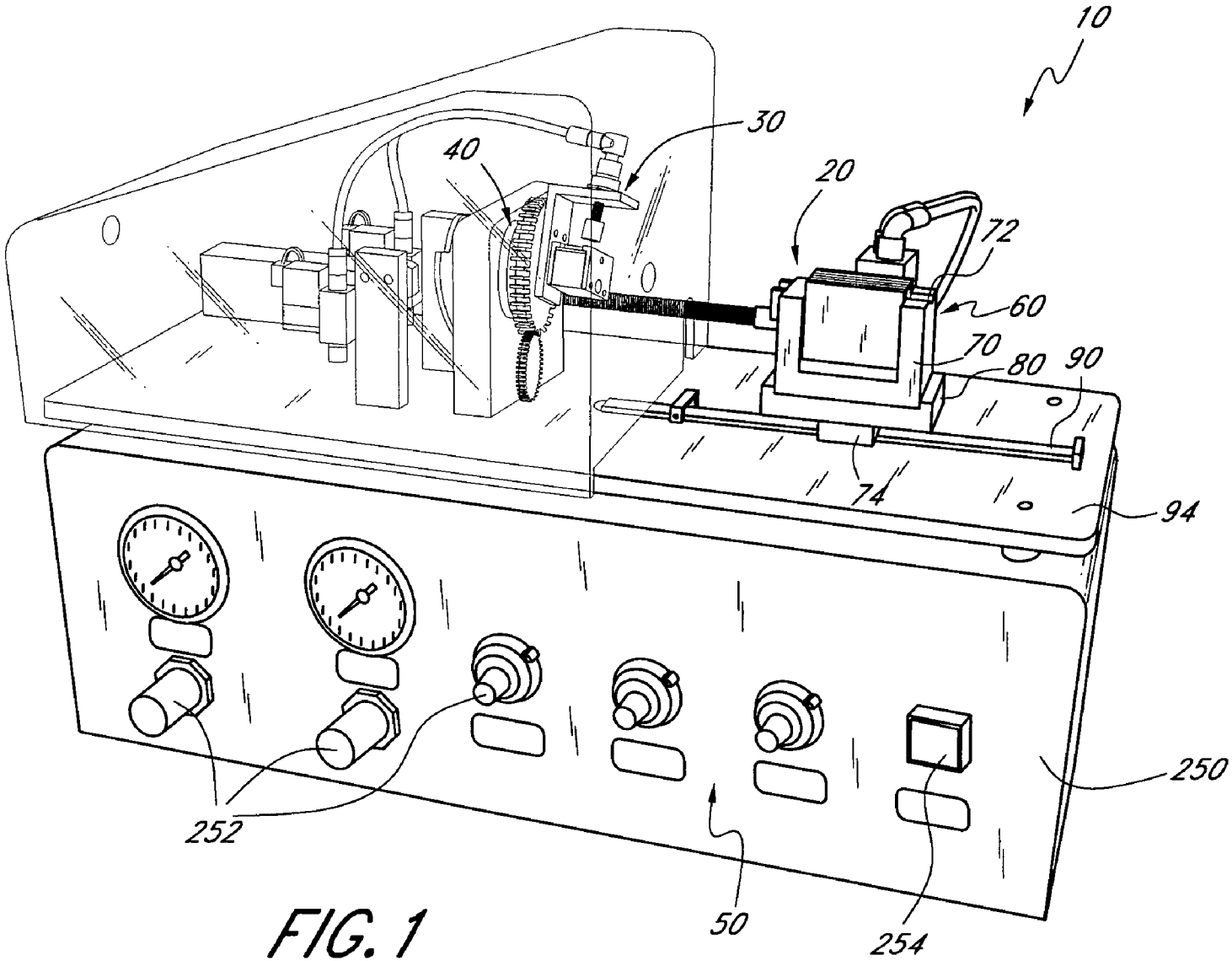
FIG. 1 is a perspective view of one embodiment of a swaging machine showing the various systems.

In the following description, reference is made to the accompanying drawings which form a part of this written description which show, by way of illustration, specific embodiments in which the invention can be practiced. It is to be understood that other embodiments may be utilized and structural changes may be made without departing from the scope of the present invention. Where possible, the same reference numbers will be used throughout the drawings to refer to the same or like components. Numerous specific details are set forth in order to provide a thorough understanding of the present invention; however, it should be obvious to one skilled in the art that the present invention may be practiced without the specific details or with certain alternative equivalent devices and methods to those described herein. In other instances, well-known methods, procedures, components and devices have not been described in detail so as not to unnecessarily obscure aspects of the present invention.

During medical procedures catheters are typically introduced into certain body cavities and passages such as the arteries, veins, intestines, esophagus, trachea, and other such generally tubular or hollow body cavities and organs. When the catheter is advanced into a passage or a cavity, parts of its surface glide along the epithelium, or sensitive lining, of the passage. To prevent an injury or damage to the lining, the catheter surface should be as smooth as possible. Accordingly, it is preferred that if the marker band projects beyond the catheter shaft surface, that it is only minimally above the catheter shaft surface. It can therefore be either partially or completely embedded in the base material of the catheter tube or shaft. The cylindrical surface of the band should also be free of any kinks, folds, or creases in order to prevent formation of ridges and sharp edges protruding above its surface which can injure the epithelium.

Additionally, kinks, folds, and creases are an indication of a non-uniform swaging process that potentially causes overstressing of the band material and may lead to a band failure and its separation from the catheter. The possibility of such a failure can cause serious harm to the patient. Furthermore, these marker band irregularities may also weaken the catheter shaft material thereby jeopardizing the shaft integrity. The surface quality and smoothness is one of the main indicators of the quality of the swaging process. Accordingly, a visual examination of the marker band surface under a microscope using 40× magnification is a standard evaluation process.

Another reason for the desired smoothness and concentricity of marker bands results from the presence of other sensitive components, such as fine polymer balloons, for example. Balloons of this type are an important part of certain catheters which may become damaged by sharp edges or protrusions of improperly swaged marker bands. For example, catheters such as percutaneous transluminal coronary angioplasty catheters (PTCA catheters) feature a thin walled polymer balloon that is permanently attached to the shaft. The marker bands are typically placed on the catheter shaft at a location that is inside the balloon. There are typically between 1 to 3 marker bands attached to the catheter shaft at appropriate locations to indicate balloon position during the medical procedure. To facilitate an easy insertion of the catheter into the patient, the polymer balloon is deflated and tightly wrapped around the shaft. Accordingly, any sharp edges or protrusions on the marker bands residing within the balloon may cause damage to the balloon wall that may lead to balloon rupture during the procedure.

The wrapped balloon profile is one of the most important catheter attributes used in selecting appropriate catheters. It determines the smallest size of the restricted blood vessel that can be dilated by the balloon. Since the balloon is wrapped on top of the marker bands, the swaged marker band diameter also adds to the overall diameter of the wrapped balloon. Accordingly, it is advantageous for the marker band to be flush or nearly flush to the catheter surface in some embodiments.

Many marker bands have a typical outer diameter (OD) within the range of from about 0.020 inches to about 0.090 inches, with some as small as 0.006 inches OD. The swaged marker bands are thus often required to conform to strict tolerances, which sometimes must be as precise as 0.0002 inches. This type of tolerance in combination with an acceptable surface finish is very difficult to achieve with current swaging machines. Most of the existing swaging machines are designed to handle large components, such as those having outer diameters of 0.125 inches and larger, and are primarily targeted for industrial applications.

Many of the current swaging machines are bulky, are typically floor standing models, and are noisy and dirty and are therefore not suitable to be operated in a clean room environment. Marker bands used for medical device purposes are preferably manufactured and/or assembled in clean conditions.

Typical swaging machines impact the marker band radially with a hammer, and either the hammer or the work piece can be rotated to vary the deformation plane. This method results in a marker band that has many scallops or dimples from the repeated impacts, and results in a marker band that not only has a poor surface finish, but has reduced holding force resulting from a non-cylindrical inside diameter (ID) and less than ideal surface area contact with the catheter. In addition, this type of localized impact can damage the structure of the catheter.

Another important consideration is manufacturing time. Marker band swaging can be a time extensive process. Therefore, during catheter manufacture, part throughput is limited, in large part, by the time required to complete the swaging process. An impact force must repeatedly and gradually deform small successive portions of the marker band with each impact. Typically, either the marker band or the impact hammer is rotated to deform the entire circumference of the marker band. The marker band is also typically fed through the impact zone, thereby deforming the marker band along its entire length. The sheer number of impacts required to deform the entire circumference and length of the marker band often results in a lengthy process. Moreover, it is often desirable to swage more than one marker band onto a single catheter. The manufacturing time geometrically increases when multiple marker bands are required on each catheter. To this end, some embodiments disclosed herein provide for a faster part throughput than currently available while providing an acceptable quality finished part.

Furthermore, the rate of rejection can be high for swaging methods and machines that impact the marker band along an impact plane. In many swaging machines, a hammer has a substantially flat impacting surface that initially concentrates its force on a small area of the marker band, and thus creates facets, dimples, or scallops around the periphery of the marker band. If the marker band is not uniformly and concentrically swaged, the marker band material can puncture or otherwise breach or damage the catheter. Accordingly, disclosed embodiments preferably substantially uniformly and concentrically swage a marker band thereby providing for a tight fit onto the catheter. This is accomplished, in part, by providing a die that does not impact the marker band along an impact plane; but rather, applies a swaging force around the circumference of the marker band.

Figure 2:
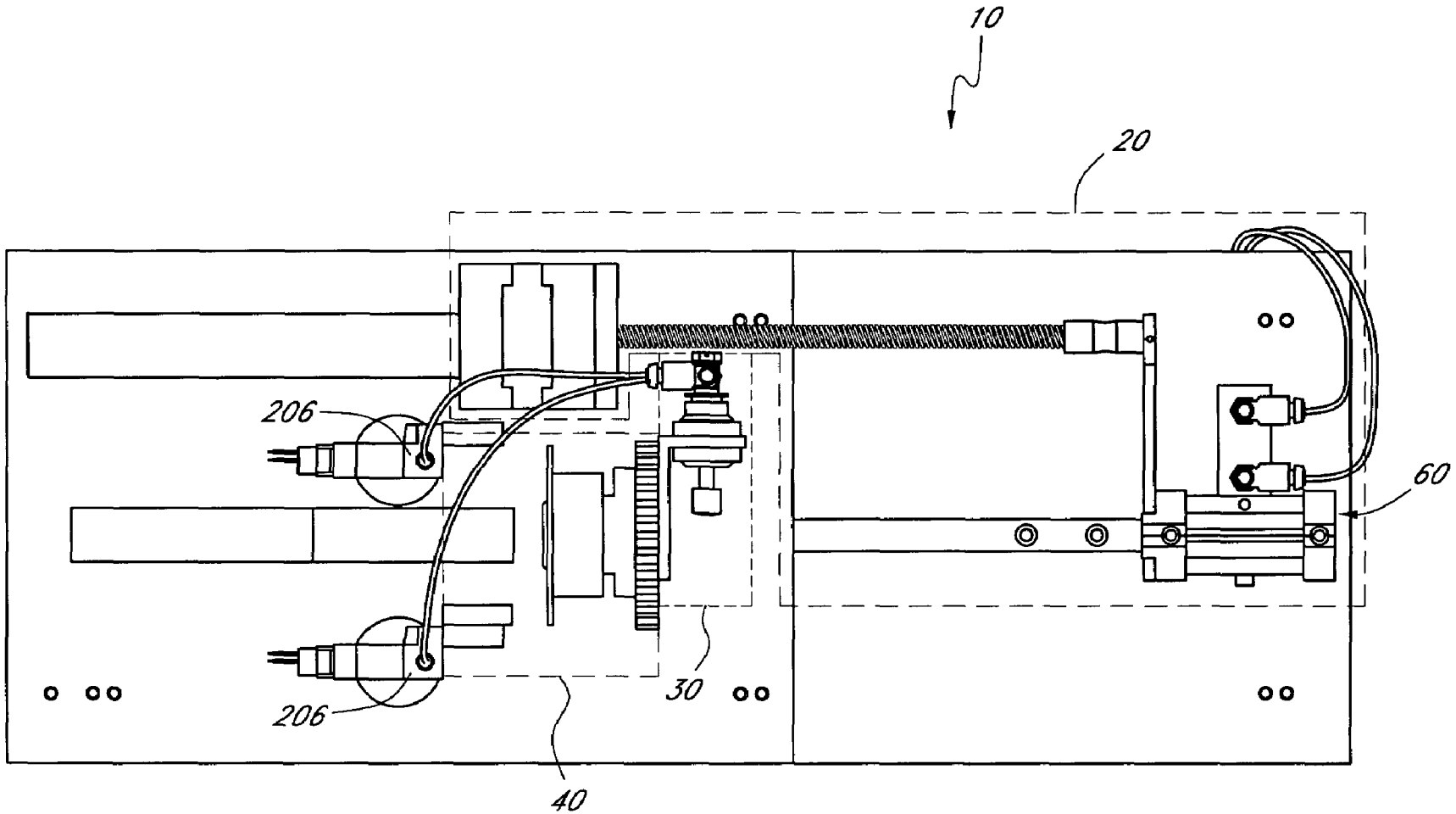
FIG. 2 is a top plan view of the swaging machine of FIG. 1.

With first reference to FIGS. 1 and 2, an examplary swaging machine is illustrated. The disclosed swaging machine 10 is particularly suited to swage one or more marker band onto a catheter.

A marker band is typically a short, thin-walled tube made of precious metal alloys, such as gold, platinum, or iridium and is usually radiopaque. Marker bands as small as 0.006 inch OD and 0.020 inches long are currently being used on catheters. Marker bands are attached to a catheter shaft, such as by swaging, to allow an x-ray technician to view the location of the marker bands, and hence the catheter, within a patient's body. The marker bands are typically configured to absorb x-rays, and are thus visible through x-ray imaging. Of course, marker bands may also be formed of materials to allow other visualization techniques to be used to verify the location of the marker bands within a patient.

A marker band has an initial inner diameter that is slightly larger than the outer diameter of the catheter upon which it is to be swaged. Accordingly, the marker band can slide over the catheter to the desired location of attachment. A secure attachment of the marker band to the catheter is achieved by reducing the diameter of the marker band, and in some applications, it becomes partially or completely embedded in the outer surface of the catheter shaft.

Depending on the catheter material, the magnitude of the resulting swaged marker band engagement varies. When swaged to a pliable polymer shaft catheter, the marker band surface may be nearly completely flush with the catheter shaft OD surface and substantially embedded into the catheter. However, when affixing a marker band to a metallic shaft or a coil spring, the area of engagement can be markedly smaller.

Swaging is a term typically used in metalworking to describe the process of tapering a rod or tube, or otherwise reducing its diameter by any suitable method. For example, forging, squeezing, hammering, and crimping, are all methods of swaging. These various methods can take advantage of the temperature effects on the marker band material to enhance the materials properties. However, in the disclosed embodiments, the swaging preferably takes place at ambient temperatures. Accordingly, the marker bands are cold worked, which increases the final marker band strength. However, cold working additionally reduces a marker bands malleability and care must be taken not to fracture the marker band during the swaging process.

In the illustrated embodiment, a swaging machine is comprised of various systems, each of which will be described in turn. A feed system 20 secures the work piece and feeds the same through an impact zone. An impact system 30 defines the impact zone and provides radial forces to the marker band around the circumference of the marker band and along its length. A rotation system 40 allows for rotation of the impact system to generate random impacts around the circumference of the marker band. Finally, a control system 50 provides power to the other systems and further allows adjustability of the process according to desired control strategies. As used herein, the term "work piece" is used to refer to a catheter and marker band combination, unless otherwise specified.

As used herein, the term marker band is a broad term. It is used to mean any type of component that may be desired to be swaged. As such, it should not be limited only to precious metal medical device marker bands, but should be construed to encompass components of various materials, sizes, configurations, and uses. Likewise, the term "catheter" is also a broad term, and in many instances, is used to refer to any type of wire, tube, rod, or other device, to which a marker band is desired to be attached.

Figure 3:
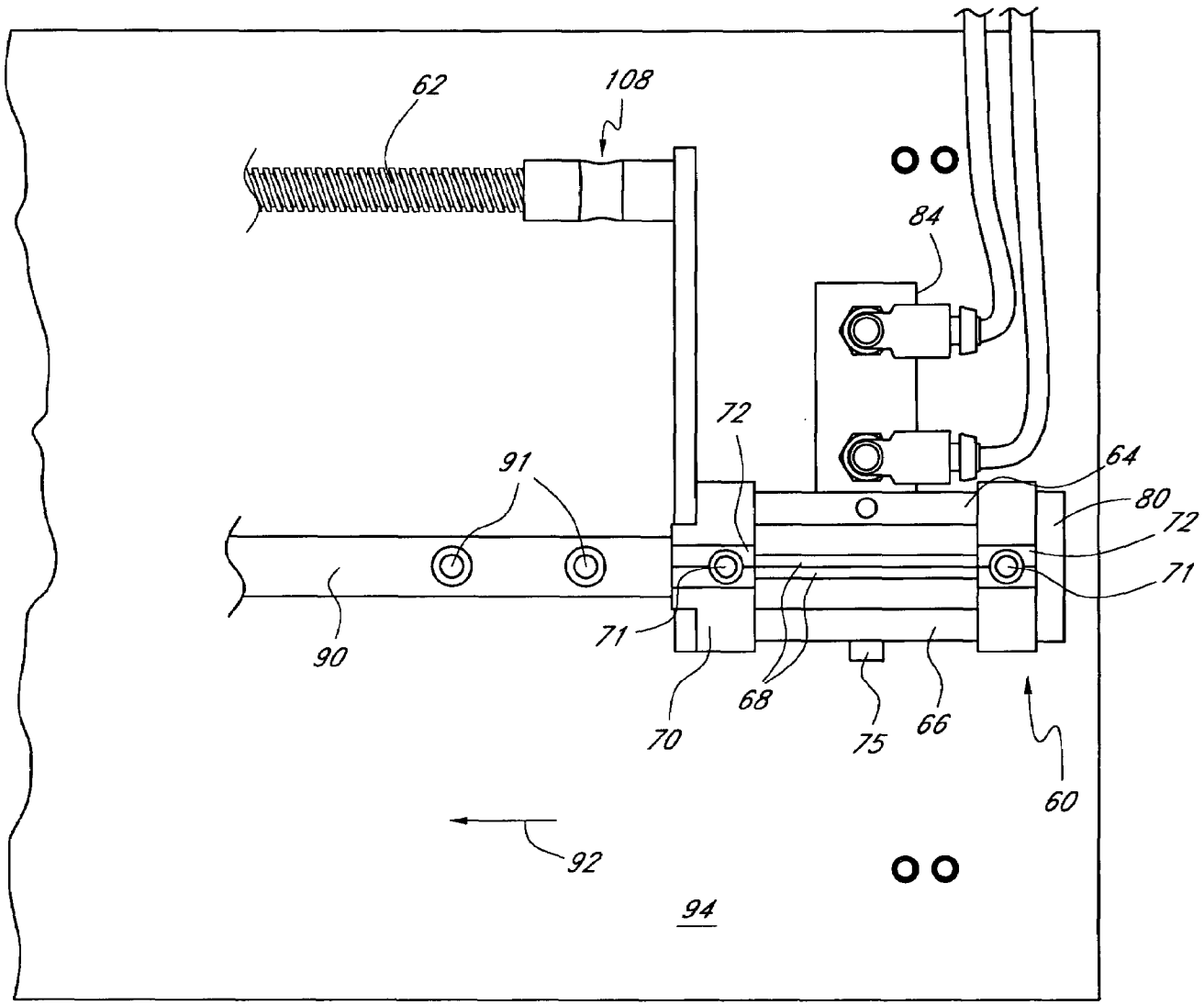
FIG. 3 is a partial top plan view of the feed system in an initial retracted position illustrating a clamp in its closed position.

With additional reference to FIGS. 1 and 3 one embodiment of a feed system 20 comprises a clamp 60 configured to securely hold the work piece and a motor-controlled feed screw 62 designed to feed the work piece at a predetermined rate according to a desired control strategy. In the illustrated embodiment, the clamp 60 comprises a first jaw 64 and a second jaw 66 formed of a suitable material, such as metal. In one embodiment, the clamp 60 is formed of a suitable steel, such as stainless steel. The first and second jaws 64, 66 further preferably carry a layer of resilient material 68, such as silicone rubber, for example, to provide a cushioned grasp on the work piece.

Figure 4:
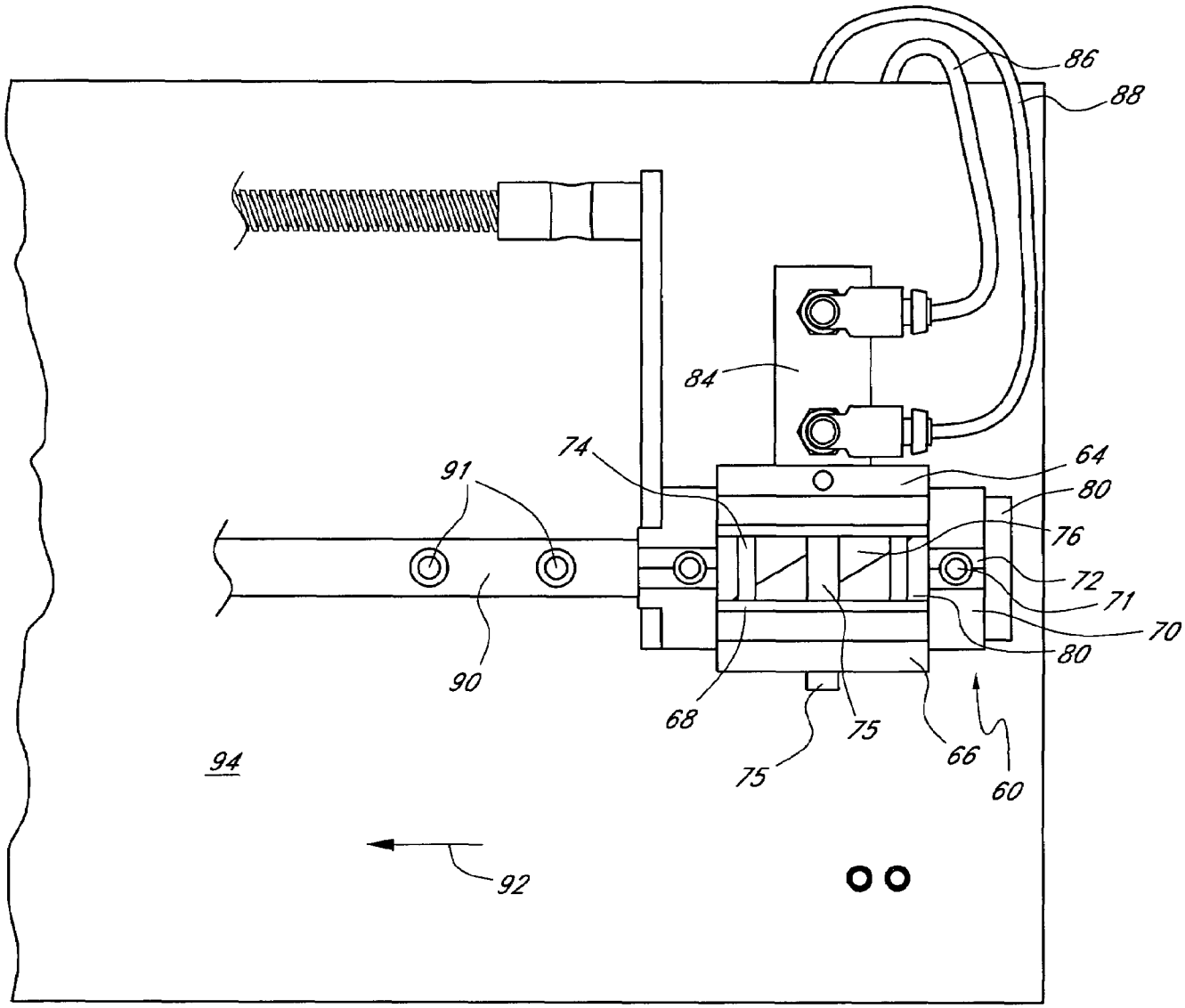
FIG. 4 is a top plan view of the feed system of FIG. 3 in a retracted position and showing the clamp in an opened position.
Figure 4A:
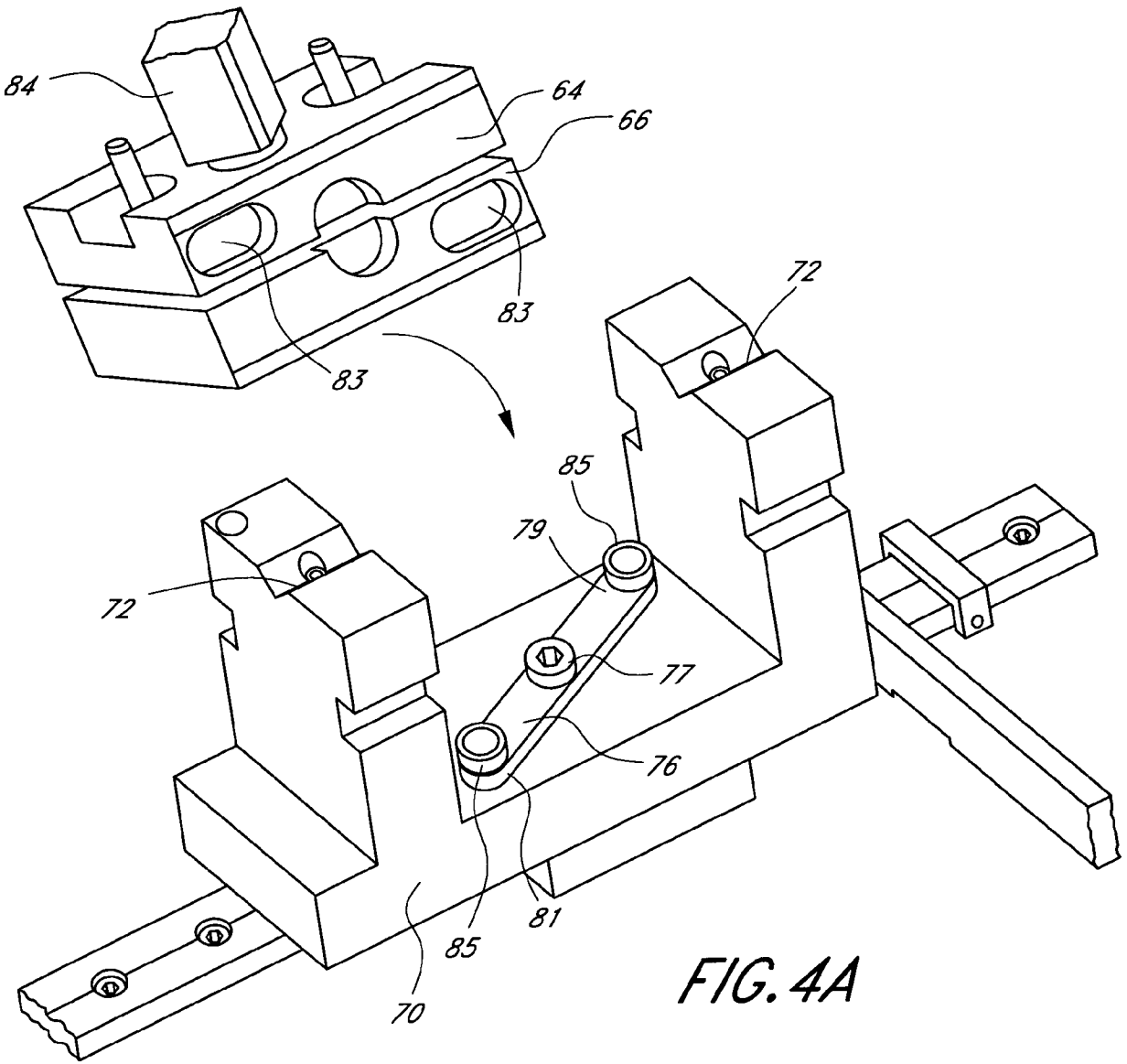
FIG. 4A is a perspective view showing the clamp components.

In one preferred embodiment, a block 70 holds the first and second jaws 64, 66 and is further configured with a guide trough 72 (see also FIG. 4A). The guide trough 72 is substantially V-shaped and provides alignment for the work piece. For example, in the illustrated embodiment, the guide trough 72 offers support to a work piece at two locations on either side of the clamp 60, and therefore, repeatable placement of the work piece is generally achieved. The guide trough 72 is appropriately sized and configured to align the work piece with the impact system 30, as will be described later in more detail. The block 70 is securely mounted to a base 80, such as by threaded fasteners 71.

In one embodiment, such as the one shown in FIGS. 4 and 4A, the clamp 60 is configured to close symmetrically about a center plane. The center plane is a vertical plane extending along the midline of the block 70 and bisecting the guide trough 72. In the illustrated embodiment, the first jaw 64 and second jaw 66 each ride on guide pins 74 disposed perpendicular to the center plane. As such, each jaw is configured to move toward the other jaw symmetrically about the center plane.

In one embodiment, the jaws are actuated by a pneumatic cylinder 84. The cylinder 84 is attached to the first jaw 64, such as through a threaded engagement. The cylinder 84 has a piston (not shown) disposed therein and a piston rod 75 extending out of the cylinder toward the clamp 60. The piston rod of the cylinder 84 passes through a bore (not shown) in the first jaw 64 and is threaded into a threaded hole formed in the second jaw 66. A first pneumatic hose 86 is attached to the cylinder and configured to move the piston in a first direction. Likewise, a second pneumatic hose 88 is attached to the cylinder and configured to move the piston in a second direction. When the first hose 86 is pressurized, the piston rod extends and moves the jaws 64, 66 apart. Likewise, when the second hose 88 is pressurized, the piston rod retracts into the cylinder 84 and the the jaws 64, 66 are brought together and the clamp 60 closes.

Referring to FIGS. 4 and 4A, the first and second jaws 64, 66 are coupled by a pivoting lever 76 which is mounted to the block 70 by a hub 77 to further encourage the first and second jaws 64, 66 to maintain equidistance from the center plane. The pivoting lever 76 is attached to each of the first and second jaws 64, 66 at a first end 79 and a second end 81. Each of the first and second ends 79, 81 of the pivoting lever 76 is configured for sliding engagement within the first and second jaws 64, 66. Each of the first and second jaws 64, 66 is configured with an oblong pocket 83 configured to receive a bearing 85 carried on each of the pivoting lever 76 first and second ends 79, 81. Thus, the jaws 64, 66 are constrained for equidistant spacing from the center plane by the pivoting of the pivoting lever 76 about the hub 77.

From the perspective of the cylinder 84, the terms "distal" or "distally" refer to a direction toward the clamp 60, while the terms "proximal" or "proximally" refer a direction away from the clamp 60. A control system 50 is configured to operate the cylinder 84 through one or more valves. In one embodiment, solenoid valves are actuated to allow pressurized air to enter the cylinder 84 through the pneumatic clamp hoses 86, 88. As the first pneumatic clamp hose 86 is pressurized, such as by a pump, the air pressure on a proximal side of the piston increases, thereby driving the piston distally and pushing the second jaw 68 away from the first jaw 66. However, because the pivoting lever 76 is connected to each jaw 66, 68 and further connected to the block 70, the jaws 66, 68 are constrained to maintain equidistance from the center plane. Likewise, as the second pneumatic clamp hose 88 is pressurized, the air pressure on the distal side of the piston increases, thereby driving the piston proximally and closing the jaws 64, 66.

Of course, the symmetrical closing nature of the jaws 64, 66 could be provided and/or controlled by other suitable apparatus and methods. For example, each jaw 64, 66 could have an associated rack gear extending in an opening and closing direction and a motor can drive one or more gears that are in meshing engagement with each rack. Thus, as the motor drives the gears, each gear linearly displaces its associated rack in opposite directions. Alternative structure for providing a suitable symmetrical clamp will become apparent to those of ordinary skill in the art in light of the disclosure herein.

Alternatively, the jaws 64, 66 need not necessarily move symmetrically about a center plane, but could be configured with one fixed jaw and one moveable jaw. However, it is preferable that the jaws hold the work piece in substantial alignment with the impact system, as will be described later in detail.

Figure 5:
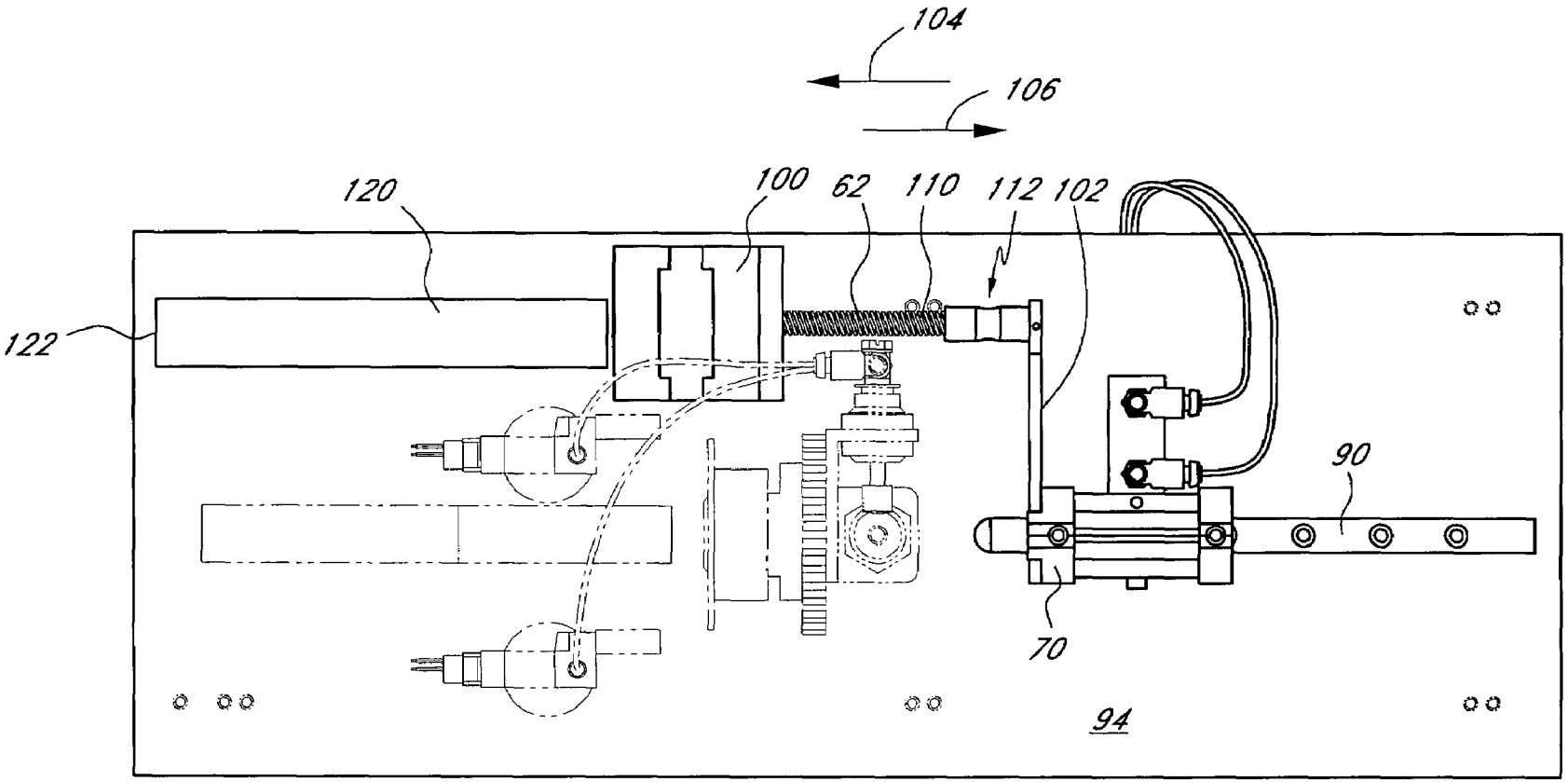
FIG. 5 is a top plan view of the feed system in an extended position.

As illustrated in FIGS. 4 and 5, the block 70 is configured to slidably ride on a rail 90 in a work piece feeding direction 92 and a work piece retracting direction, which is opposite to the work piece feeding direction 92. The rail 90 is securely mounted to a housing deck 94 by any suitable method, such as fasteners 91 or welding. The rail 90 allows for the clamp 60 and work piece to be linearly translated along the longitudinal axis of the work piece. When fasteners 91 are used to secure the rail to the housing deck 94, the fasteners are preferably countersunk or otherwise configured so that they do not interfere with the slidable displacement of the clamp 60. This allows the work piece to be fed into the impact system 30, as described later.

In one embodiment, the block 70 is driven along the rail 90 by a motor. With specific reference to FIG. 5, a stepper motor 100 is in driving engagement with the feed screw 62 that is coupled to the block 70 by a drive arm 102. The drive arm 102 is affixed to the block 70 at any suitable location and in any suitable manner and provides a remote driving location for the block 70 so that the motor 100 can be advantageously located out of the way of the work piece and the impact system 30. The drive arm is preferably configured to have sufficient rigidity such that the displacement of the feed screw is efficiently converted to equal translation of the clamp 60. This may be enhanced by providing a drive arm formed of sufficiently rigid materials or of sufficient dimension to negate any deformation due to the bending moment applied on the cantilevered drive arm 102.

In the illustrated embodiment, a stepper motor 100 drives a ball screw nut (not shown) around the feed screw 62. Accordingly, as the motor 100 rotates the ball screw nut, the feed screw 62 translates linearly along the screw axis. The stepper motor 100 drives the feed screw 62 in an advancing direction 104 and a retracting direction 106 which imparts a linear displacement to the block 70 through the drive arm 102. The advancing direction 104 and retracting direction 106 are viewed from the perspective of the clamp 60 in relation to the impact system 30. Thus, activation of the motor 100 displaces the block 70 with accompanying work piece in a linear direction toward or away from the impact system 30. The interaction between systems will be discussed later in greater detail.

The feed screw 62 will have a tendency to vibrate in response to the swaging action, especially along unsupported lengths, such as when the feed screw is in a retracted position as shown to FIG. 2 where the clamp is retracted away from the impact system 30. In fact, during operation of the swaging machine, the vibrations experienced by the feed screw 62 can resonate at the feed screw's natural frequency which may cause the feed screw 62 to vibrate violently. Accordingly, it becomes advantageous to dampen the feed screw vibration.

Figure 6:
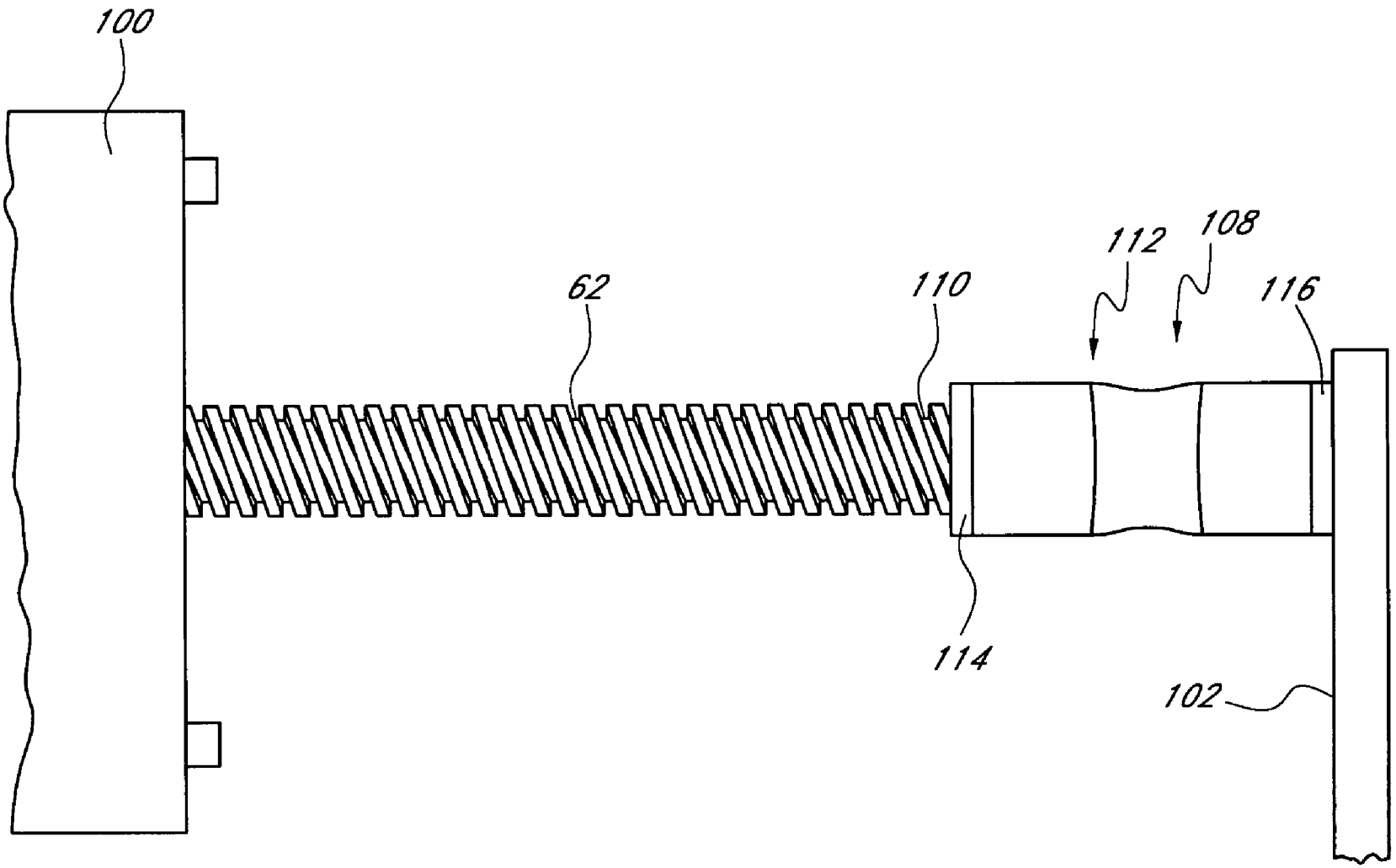
FIG. 6 is a top plan view of the feed screw of the feed system and its coupling with the clamp.

Referring to FIGS. 5 and 6, one embodiment utilizes a flexible link 112. The feed screw 62 has a coupled end 110 coupled to the drive arm 102, and a free end extending into and through the motor 100. The coupled end 110 of feed screw 62 is coupled to the drive arm 102 by the flexible link 112. An appropriate mount is affixed to the feed screw 62 and to the drive arm 102 to accept the flexible link 112. In one embodiment, a screw mount 114 is formed of Delrin® and threads onto the coupled end 110 of the feed screw 62. An arm mount 116, also formed of Delrin® is attached to the feed arm 102 in any acceptable manner, such as by a screw or bolt. The screw mount 114 and the arm mount 116 are generally cylindrical and may have a diameter larger than that of the flexible link 112 to provide a holding force between the respective mount and the flexible link 112. The flexible link 112 is fitted over the arm mount 116 and screw mount 114 and is secured in any suitable manner, such as by a frictional engaging force. Optionally, each mount 114, 116 may be configured with ribs or ridges to provide an increased frictional holding force to the flexible link 112.

In one preferred embodiment, the flexible link 112 is formed of polyurethane (PU) tubing. One reason for utilizing PU tubing is due to its viscoelastic properties. Rather than exhibit true elastic properties, where the material snaps back to its original state upon release of a load, polyurethane tends to gradually return to its initial shape, thereby attenuating and damping the feed screws 62 tendency to vibrate. An appropriate length of tubing is required to provide the beneficial damping characteristics. However, excessive length of tubing can introduce slop into the feed system 20. In some preferred embodiments, the unsupported length of the PU tubing is within the range of about ⅛ inches to about ¼ inches. Of course, the disclosed length is exemplifying and is not the only length of tubing that provides the desired benefits. In one preferred embodiment, the PU tubing has a ¼ inch ID with a 1/16 inch wall thickness and a hardness within the range of about 60–70 ShoreA. Those of skill in the art will readily realize other types and/or sizes of tubing are implementable to provide the advantages disclosed herein.

The stepper motor 100 will have a tendency to bind if the feed screw 62 is not properly aligned with the ball screw nut. The flexible link 112 additionally allows the feed screw 62 to self-adjust in order to achieve proper alignment with the stepper motor 100. This is most noticeable when the feed screw 62 is in an initial position, such as in FIG. 2, where the feed screw 62 is in a retracted position. In this position, only a small length of the feed screw 62 is within the stepper motor 100, and any force applied to the feed screw 62 at a location close to its coupled end 110 causes a significant moment about the interconnection with the ball screw nut. As the stepper motor 100 begins driving the feed screw 62, the flexible link 112 allows the feed screw 62 a small threshold of movement in which it can self-align within the stepper motor 100. Accordingly, any displacement or moment forces on the feed screw 62 can be compensated for because the flexible link 112 allows the coupled end 110 of the feed screw 62 to move slightly to allow self-alignment within the stepper motor 100.

The feed screw 62 is advanceable from an initial position, or retracted position in which the clamp 60 is retracted away from the impact system 30 as shown in FIG. 2, to an extended position in which the clamp 60 is extended toward the impact system 30, as shown in FIG. 5. A feed screw housing 120 is mounted to the deck 94 to cover the feed screw 62 as it moves in an advancing direction 104. The motor 100 preferably has a travel limiter that prevents the feed screw 62 from being driven too far. Without a travel limiter, the clamp 60 could be driven to contact portions of the impact system 30, or the stepper motor 100 could stall from the lack of additional feed screw 62 threads which could damage the motor 100 components. In one embodiment, a Hall effect limiting switch (not shown) is used to set the travel limit of the stepper motor 100.

In one embodiment, the Hall effect limiting switch includes a magnet (not shown) mounted on the free end of the feed screw 62, and a sensor (not shown) mounted toward a first end 122 of the feed screw housing 120. As the feed screw 62 extends into the feed screw housing 120, the sensor senses the proximity of the magnet and sends a signal to the control system 50 which instructs the stepper motor 100 to discontinue advancing the feed screw 62.

In other embodiments, the travel limits of the feed screw 62 could be under the control of the control system 50, with the control system 50 setting an initial position and travel limit positions such that it will control the stepper motor 100 to turn up to a predetermined maximum number of revolutions in a given direction. Alternatively, mechanical means can be applied to limit the travel. For example, the feed screw 62 can be configured with an annular groove at the end of the threads, such that the ball screw nut rides in the groove once it has been driven through the threads. The threads can be suitably configured such that reversing the motor direction causes the ball screw nut to enter into the thread flutes and resume driving the feed screw 62 in an opposite direction. Alternatively, an interfering stop can be disposed on the rail 90 such that further displacement of the clamp 60 is inhibited. Other travel limiters are also contemplated herein as will be apparent to those of skill in the art in light of the present disclosure.

The feed system 20 thus securely holds a work piece in the clamp 60, and feeds the work piece into the impact system 30 according to a control strategy governed by the control system 50 as will be described in greater detail below.

Figure 7:
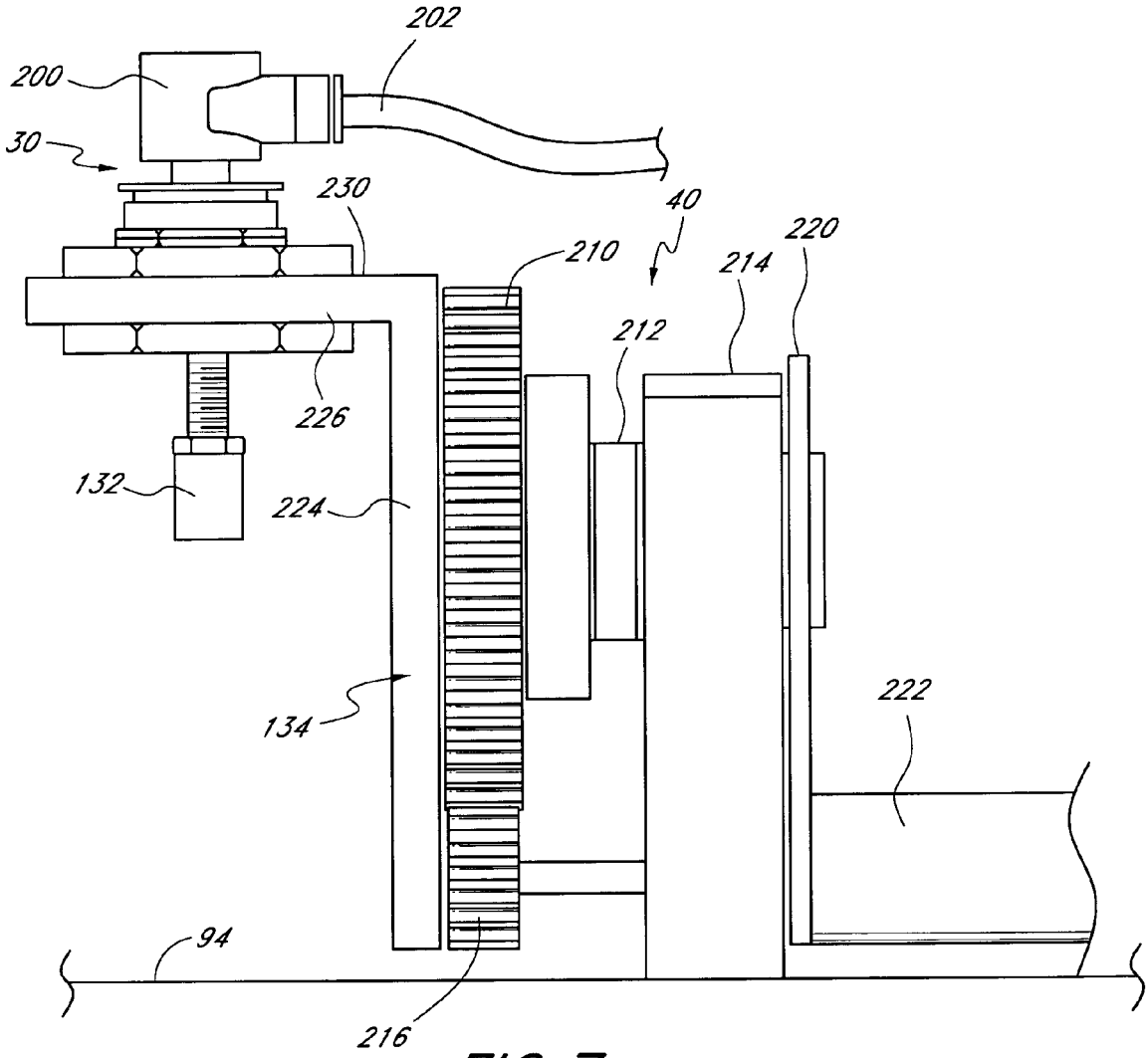
FIG. 7 is a side perspective view illustrating the various components of the impact and rotation system of one embodiment of a swaging machine.
Figure 8:
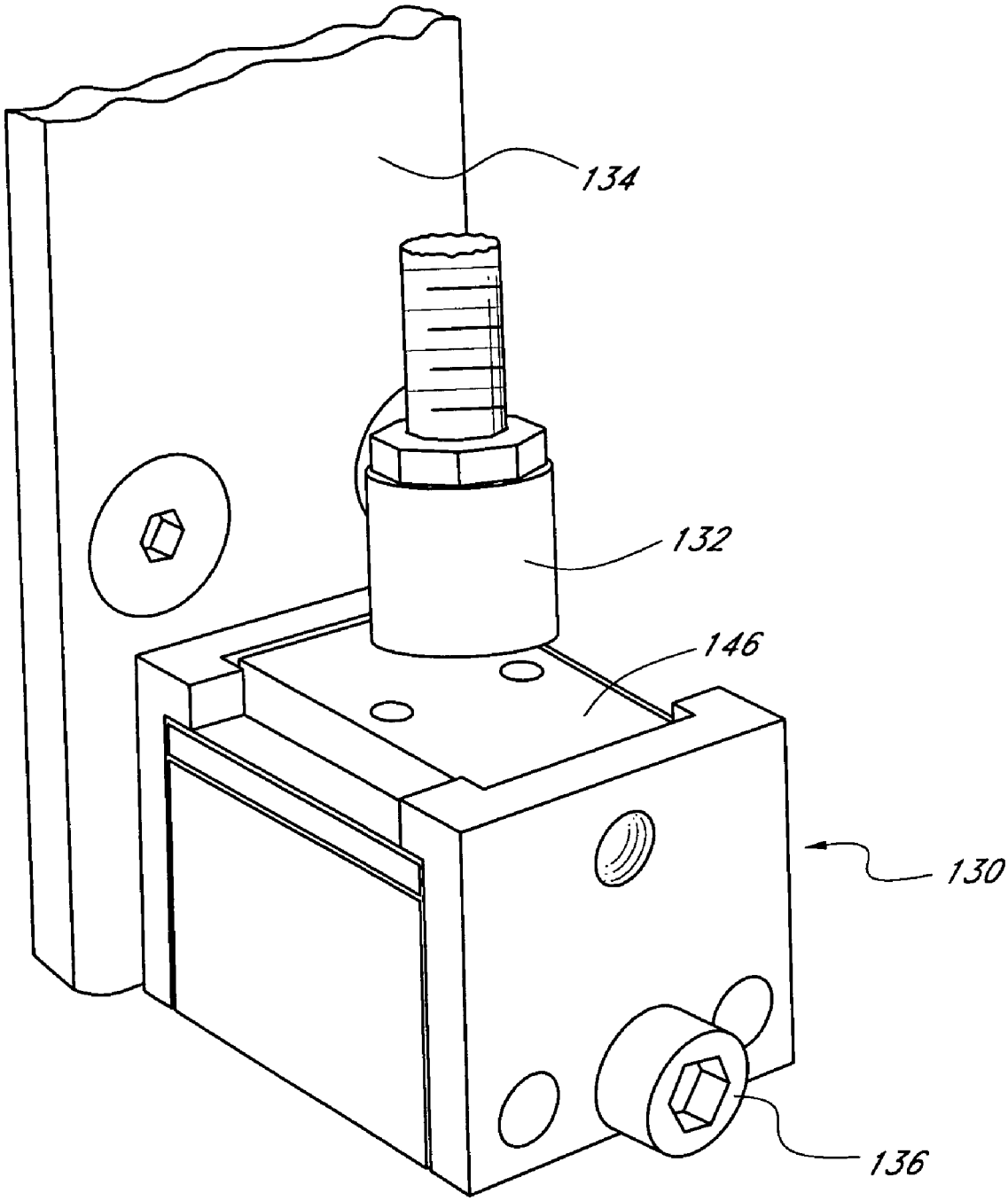
FIG. 8 is a close-up perspective view of the impact system of one embodiment of a swaging machine and a die used in conjunction with the swaging machine.

With reference to FIGS. 7 and 8, the impact system 30 generally comprises a die 130 that contains a swaging cavity (not shown) into which the work piece is fed and a hammer 132 that impacts the die 130 to provide a swaging force to the work piece. The die 130 and hammer 132 are mounted onto a swivel plate 134 that provides an interface between the impact system 30 and the rotational system 40, to be described later.

The die 130 is mounted to the swivel plate 134 in any suitable manner, such as by a bolt 136, as illustrated. The hammer 132 is likewise mounted to the swivel plate 134 in any suitable manner such that the hammer 132 is generally adjacent the die 130. Before further describing the impact system, the die 130 will be described in detail which will aid the understanding of the later described impact system. For now, it is sufficient to note that the impact system hammer 132 provides an impact onto the die 130.

Figure 9:
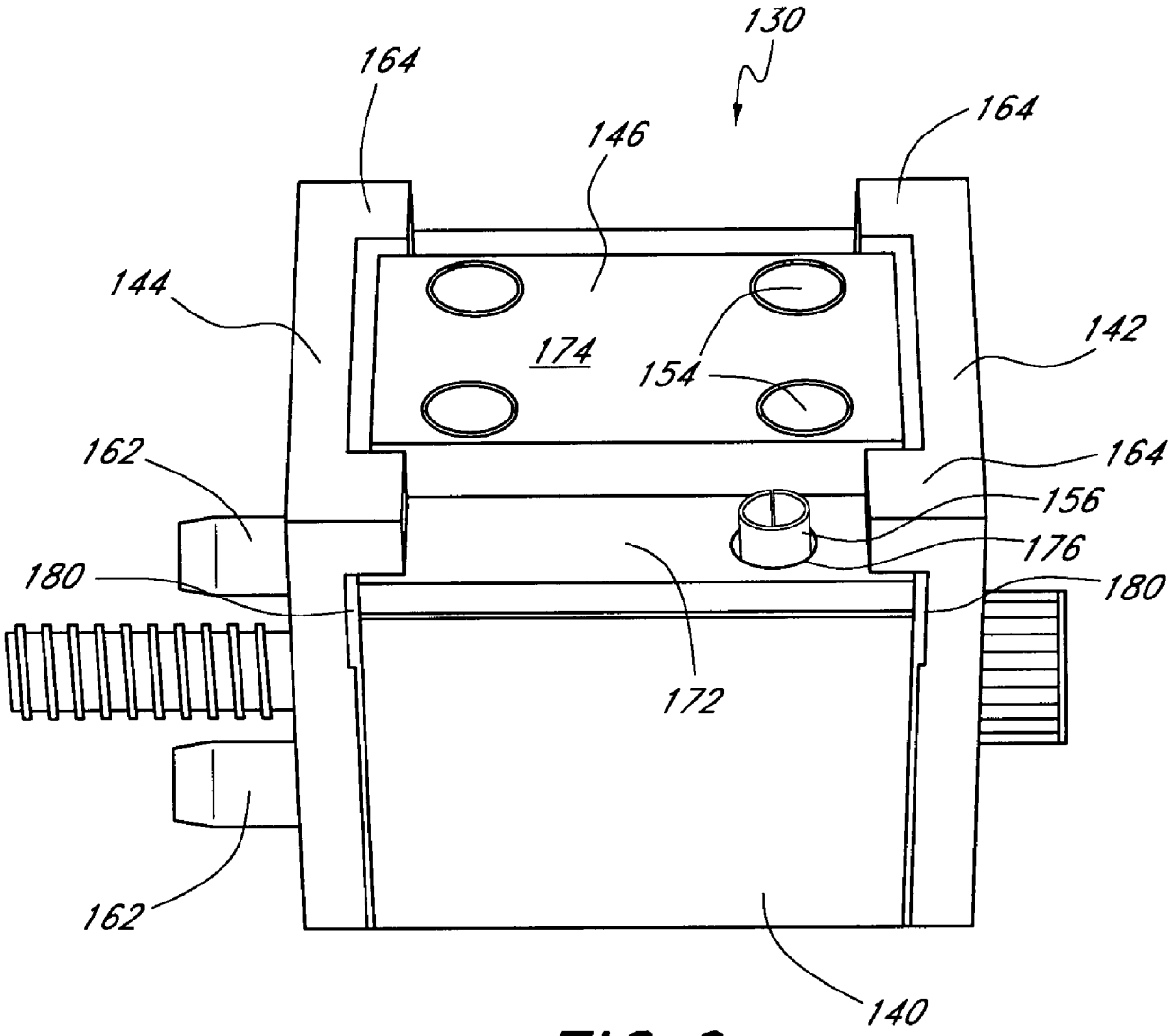
FIG. 9 is a side perspective view of a die for use in conjunction with a swaging machine.
Figure 10:
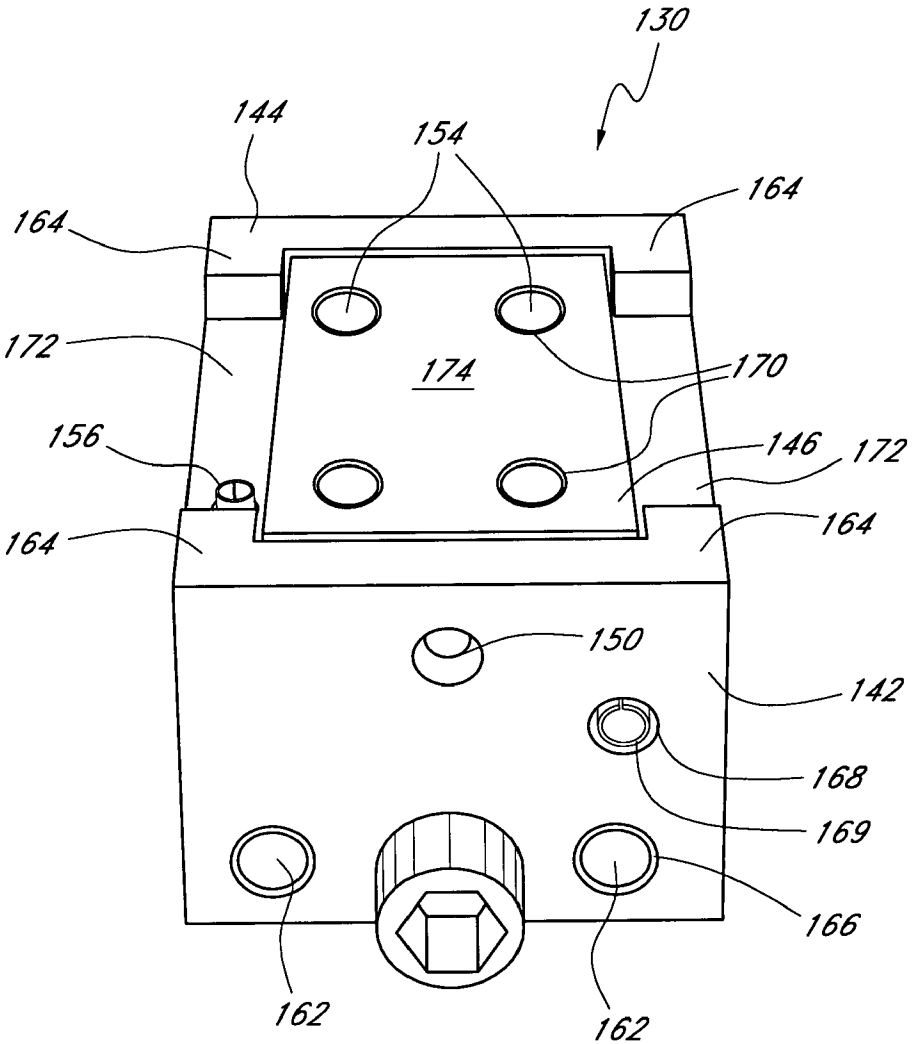
FIG. 10 is a front perspective view of the die of FIG. 9.

In the illustrated embodiments of FIGS. 9–10, the die 130 is shown assembled and removed from the swivel plate 134 and comprises an anvil 140, a front plate 142, a rear plate 144, and an impact plate 146. For convenience, the die will be described as receiving an impact on its top surface, while the work piece is fed through a feed hole 150 in the front plate 142 and exits through an exit hole 152 in the rear plate 144. Accordingly, the impact plate 146 sits on top of the anvil 140. For continued convenience and description, the die's longitudinal axis is the axis extending between the front plate 142 and the rear plate 144, which is additionally parallel to the feeding direction of the work piece when the die 132 is mounted to the swivel plate 134 as shown in FIG. 8.

Figure 11:
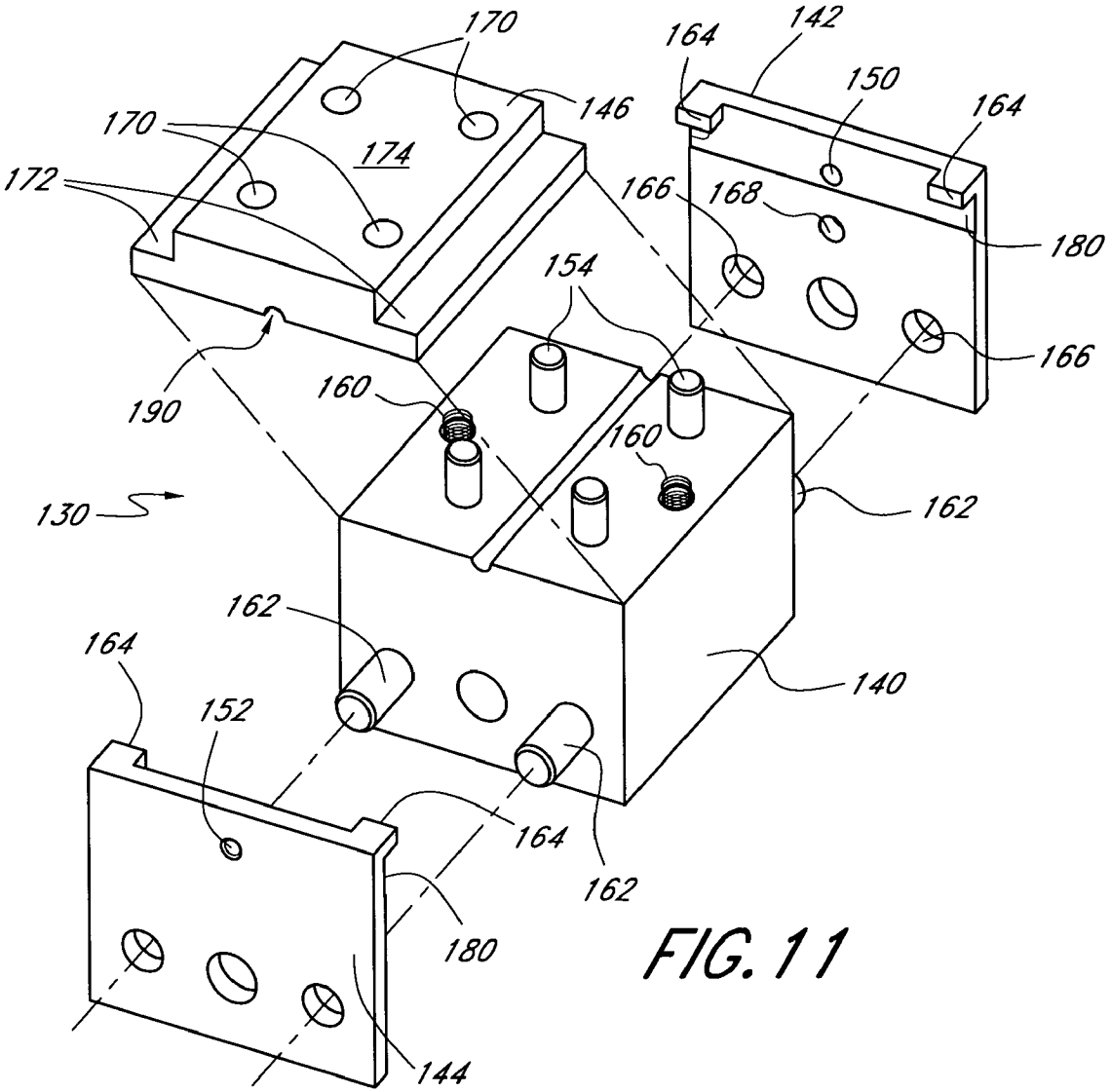
FIG. 11 is an exploded view of another embodiment of a die for use with a swaging machine.

With additional reference to FIG. 11, one preferred die embodiment comprises an anvil 140 formed as substantially a solid block having holes in its top face, front face, and rear face. The anvil 140 has one or more holes in its top surface to receive one or more upper guide pins 154. The upper guide pins 154 are preferably configured to withstand wear, and in one embodiment, are formed of stainless steel that has been heat treated and chromium plated to a hardness within the range of about 60 HRC to about 72 HRC, and in one embodiment, has been heat treated to a hardness of about 70 HRC. The pins 154 can be installed into mounting holes formed in the top surface of the anvil 140 and secured there by friction or by any suitable mechanical, chemical, heat bonding or other suitable method. Alternatively, the pins 154 can be formed integrally with the anvil 140, such as during casting or machining. The pins 154 are preferably rounded to inhibit sharp edges from wearing against mating components. The anvil 140 may further be configured with one or more line-up pins 156 to facilitate assembly, to be described below.

The anvil 140 has additional holes in its top surface to accommodate one or more coil springs 160, which will be discussed in greater detail later. One or more mounting pins 162 are installed into holes extending from the front surface and the rear surface of the anvil 140. The mounting pins 162 provide alignment and mounting for the front plate 142 and rear plate 144 to the anvil 140, and further aid in mounting the die 130 to the swivel plate 134. Finally, the anvil 140 has a mounting hole formed longitudinally therethrough to accept a threaded fastener 136 (of FIG. 8) for mounting the die to the swivel plate 134.

The anvil 140 is formed of any suitable material, but in one preferred embodiment, is formed of stainless steel that has been heat treated to a hardness within the range of from about 55 HRC to about 65 HRC, and in one embodiment, is about 60 HRC. The anvil 140 may be formed by any suitable process, such as casting, machining, or through wire electrical discharge machining (wire EDM), for example, or a combination of any suitable processes.

The front plate 142 is substantially a flat metal plate formed of similar methods and materials as those disclosed in conjunction with the anvil 140. The front plate 142 generally conforms to the size and shape of the front face of the anvil 140, and extends above the front face of the anvil and is formed with one or more projections 164 that extend over the top surface of the anvil 140. The projections 164 are travel stops, and will be defined in greater detail later.

The front plate 142 is configured with one or more mounting holes 166 corresponding to the size and location of the mounting pins 162 on the anvil 140 and configured with a diameter slightly larger than the mounting pins 162 such that the mounting pins 162 securely fit within the mounting holes 166. By providing more than one mounting pin 162, relative motion between the front plate 142 and the anvil 140 is inhibited, and generally, two or more mounting pins 162 are desired.

The front plate 142 is further configured with an optional hole 168 corresponding with a line-up pin 169 extending from the front face of the anvil 140. The line-up pin 169 extending from the front face of the anvil 140 and corresponding alignment hole 168 in the front plate 142 help to assure that the front plate 142 and rear plate 144 are properly installed in their proper locations, and are not swapped one for the other. The line-up pin 169 and corresponding front plate alignment hole 168 are merely for alignment only, and therefore, are not required to adhere to any strict design tolerance.

Finally, the front plate 142 is configured with a feed hole 150 configured to receive the work piece. The feed hole 150 is a through hole extending from the outside face of the front plate 142 through the rear face of the front plate 142. Preferably, as illustrated, the feed hole 150 is chamfered to provide a lead-in funnel for the work piece. Not only does this aid with initial entry of the work piece into the die 130, but breaking the edge of the feed hole 150 offers the additional advantage of allowing smooth feeding of the work piece through the die 130, while reducing the tendency for the work piece to bind with any sharp leading edges of the feed hole 150.

The rear plate 144 is configured substantially similarly to the front plate 142, as described including the described travel stops 164. Notable differences include omission of the optional alignment hole for those embodiments that utilize a line-up pin on only the front surface of the anvil. Alternatively, or additionally, a line-up pin can be provided on the rear surface of the anvil, and a corresponding alignment hole can be formed through the rear plate. However, the front plate 142 and rear plate 144 wear differently over time, and in order to maintain a die that meets strict design tolerances, the front plate 142 and rear plate 144 are preferably configured such that they are not interchangeable with one another. Thus, in embodiments where both the front surface and rear surface of the anvil 140 are configured with line-up pins, it is preferable that they are not identically placed, thus providing some indication of the proper location of the front plate 142 and the rear plate 144 and disallowing interchangeability between the two.

With particular reference to FIG. 11, the impact plate 146 perimeter generally corresponds with the shape of the anvil 140 upper surface, and is configured with alignment holes 170 to correspond with the alignment pins 154 of the anvil 140. It is preferable that the alignment holes 170 are precisely located, and in one embodiment, the alignment holes 170 are keyhole cut during a wire EDM process that locates the holes to within about 0.0001 inch accuracy. The edges of the alignment holes 170 are preferably broken so they do not present any sharp surfaces that can interact with the alignment pins 154 and cause wear. One way of breaking the hole edge is by running a cotton string saturated with diamond paste along the edge.

The impact plate 146 is additionally configured with edge set down areas 172 on its top surface along its longitudinal edges to not only reduce the impact plate's mass, but to also cooperate with the travel stops 164 of the front plate 142 and rear plate 144, as described below.

In between the edge set down areas 172, the impact plate 146 has a thicker central portion 174 configured to receive an impacting blow, as described later. The impact plate 146 may further have an alignment hole 176 (FIG. 9) configured to receive the line-up pin 156 protruding from the upper surface of the anvil 140 to facilitate attaching the impact plate 146 in the proper orientation relative to the anvil 140.

In other embodiments, such as the one illustrated in FIG. 11, a plurality of mounting pins 154 can be irregularly positioned across the anvil 140 upper surface and the impact plate 146 can have corresponding alignment holes 170 formed therein. This type of irregular positioning of the mounting pins 154 serves to assure proper orientation of the impact plate 146 relative to the anvil.

The die is simply assembled by first sliding the impact plate 146 over the upper mounting pins 154. Subsequently, the front plate 142 and rear plate 144 are mounted onto their respective mounting pins 162 such that their respective travel stops 164 extend over the edge set down areas 172 of the impact plate 146.

In the illustrated embodiments, the front plate 142 and rear plate 144 each have a relief groove 180 which allows the impact plate 146 to move freely between its travel limits absent friction from the travel stops 164. Accordingly, the impact plate 146 is moveable between a first position in which the impact plate 146 is in surface contact with the anvil 140, and a second position in which the impact plate is disposed away from the anvil and the edge set down areas 172 are in contact with the travel stops 164 of the front and rear plates 142, 144.

As discussed earlier, the upper anvil 140 surface is configured with one or more holes which each contain a coil spring 160. Thus, upon assembly, the impact plate 146 is biased away from the anvil 140 by the coil springs 160, and is moveable between its second position and first position by applying a force onto the upper surface of the impact plate 146 sufficient to overcome the spring force.

An important consideration when swaging marker bands is the manufacturing time required to effect swaging. The speed of the swaging process is limited, in part, by the speed of the die 130 as it cycles between its first and second positions. The speed of the die is determined, in part, by the mass of the impact plate 146 and the characteristics of the coil springs 160. Accordingly, in one embodiment, the impact plate 146 is designed to have a relatively small mass, thereby reducing the inertia of the impact plate 146 and allowing it to cycle faster. For example, in one particular die embodiment, the impact plate 146 has a mass of about 3.9 grams, which allows a cycle frequency of up to 30 Hz, or more. Of course, additional components, such as those in the impact system 30, may also impose limits on the cycle time and will be discussed later in greater detail.

As discussed above, the front plate 142 and rear plate 144 each include travel stops 164 to limit the displacement of the impact plate 146. In one preferred embodiment, the travel limit, or throw, of the impact plate 146 is within the range of from about 0.001 inches to about 0.025 inches. In some embodiments, the travel limit is within the range of from about 10% to about 13% of the swaged part diameter. For example, for a marker band having a diameter of 0.030 inches, an acceptable throw of the impact plate is about 0.003 to about 0.004 inches.

A die 130 having a large throw presents possible disadvantages. For example, the impact cycle frequency is limited, in part, by the capable speed of the die 130 as it returns to its open position. Therefore, by minimizing the die 130 throw, the cycle frequency can be increased. Another possible result is that a die 130 with a large throw will form "ears" on the marker band, which are portions of the marker band that extend radially and are often caused by the marker band material becoming pinched between the anvil 140 and impact plate 146. A small die throw inhibits the formation of ears by disallowing any portion of the marker band from becoming pinched between the die halves.

Figure 12B:
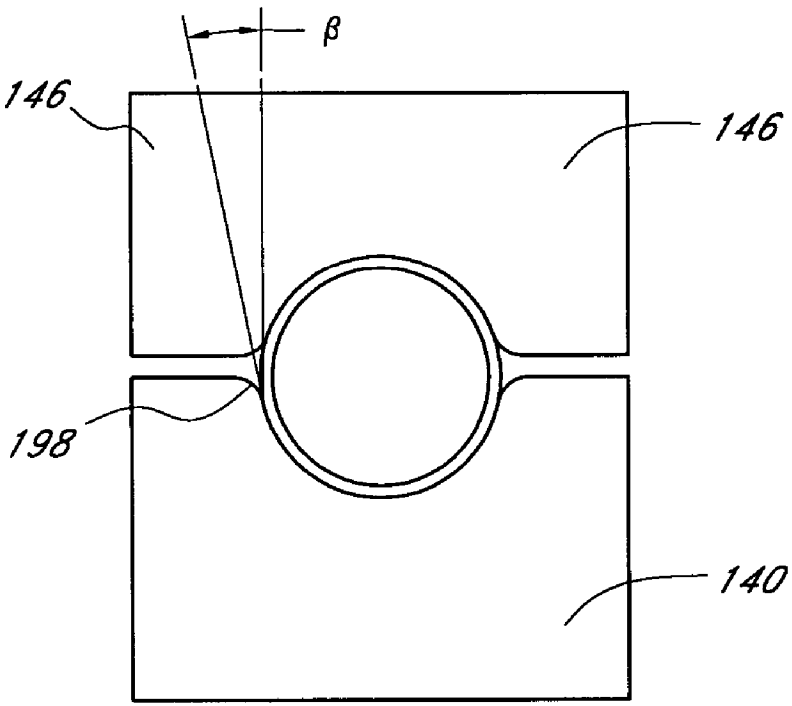
FIGS. 12A and 12B are a cross-sectional views of the die cavity of the die of FIG. 11.
Figure 12A:
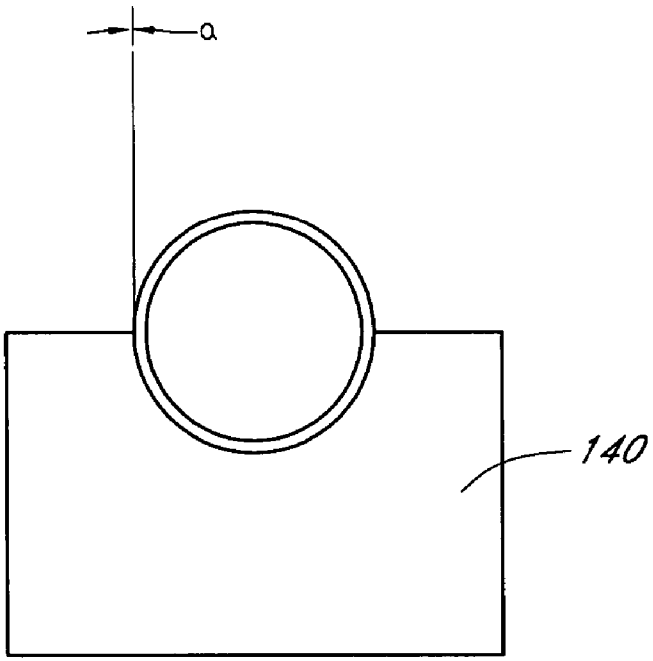
Figure 13:
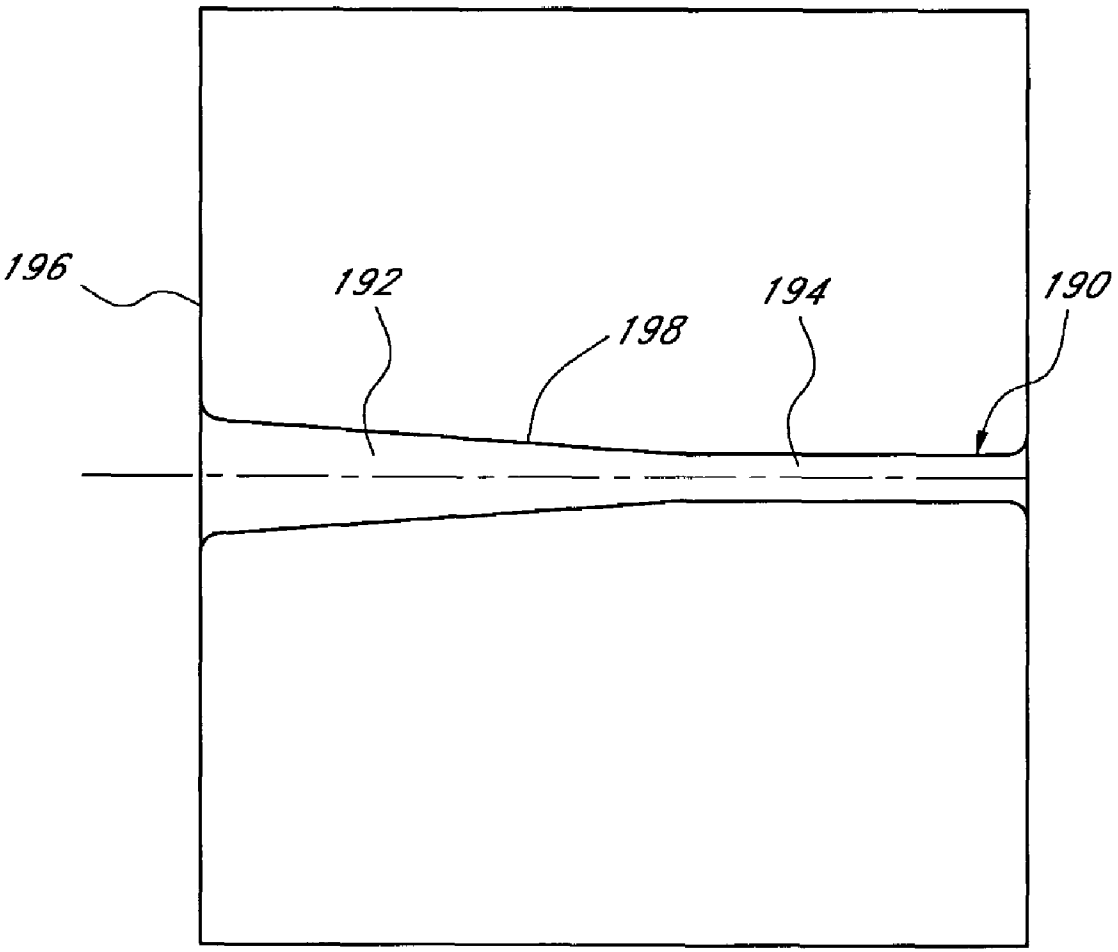
FIG. 13 is a top plan view of a die cavity.

The impact plate 146 and the anvil 140 cooperate to define a swaging cavity 190 within the assembled die 130. In one preferred embodiment, the die cavity is split between the impact plate 146 and the anvil 140, hence the term split die is used to describe this type of die. With reference to FIGS. 12A, 12B, and 13, the swaging cavity 190 formed by juxtaposing the cavity of the anvil 140 and the cavity formed in the bottom face of the impact plate 146. The swaging cavity 190 comprises a frustroconical portion 192 defining a taper leading to a substantially cylindrical cavity section 194.

The tapered portion 192 has a larger diameter at the front edge 196 of the die and gradually tapers to a diameter corresponding with the desired finished outer diameter of the swaged marker band. The cylindrical portion 194 of the cavity 190 has a diameter that corresponds with the finished outer diameter of the swaged marker band. In one particular die embodiment, the tapered portion is about 0.375 inches long and the cylindrical portion is about 0.270 inches long.

In one embodiment, the impact plate 146 and the anvil 140 are both formed of heat treated stainless steel that has been treated to a hardness of about 64 HRC. The die cavity 190 is preferably longitudinally and symmetrically split between the mating surfaces of the impact plate 145 and anvil 140. In one embodiment, the die cavity 190 is preferably formed by wire EDM, and subsequently polished to a mirror finish. One way of achieving this surface finish is by using a fine abrasive against the surface, such as by saturating a cotton string with diamond paste and running the string along the cavity surface. It has been found that this particular technique can result in a diameter accuracy to within about 0.0001 inches.

One potential issue when using a split die 130 of this nature is the tendency of the work piece to lock up and frictionally bind within the die cavity 190. For example, when a cylindrical work piece is placed into a true semi-cylindrical cavity, the sides of the cavity will be in surface contact with the semi-circumference of the work piece. Accordingly, as the work piece tries to exit the cavity in a radial direction, the two lines of friction between the work piece and the cavity will be diametrically located on the perimeter of the work piece and extend longitudinally down the sides of the work piece. As such, the friction angle $\alpha$ between the work piece and the cavity is zero degrees (See FIG. 12A). With a zero degree friction angle $\alpha$, the work piece will tend to bind within the cavity. One way of reducing the friction between the work piece and the die, and thus allowing the work piece to be easily removed from the die, is to increase the friction angle between the engaged components, as illustrated in FIG. 12B.

As illustrated in FIG. 12B, the edge 198 of the die cavity 190 has a radius. In one embodiment, the die cavity 190 edge radius is formed to be about 0.25 times the radius of the die cavity 190. In one particular embodiment, this die cavity edge radius provides a friction angle $\alpha$ of about 11 degrees, which has been found sufficient to inhibit lock-up of the work piece during swaging. Of course, other friction angles are possible and will provide the benefits described.

It is advantageous that the marker band diameter reduction is gradual, otherwise striations, folds, and "ears" can form on the marker band. Accordingly, in one embodiment, the tapered portion 192 of the die cavity 190 is about 0.375 inches long having a diameter taper within the range of about 0.008 to about 0.010 inches per inch. Accordingly, the tapered portion 192 of this embodiment has an included angle within the range of about 0.9 to about 1.15 degrees. An appropriate feed rate can be selected to provide an acceptable finish, as will be described later.

Of course, those of ordinary skill will readily realize that the recited dimensions are illustrative of one particular embodiment of a die 130 and die cavity 190 and that other dimensions are fully contemplated within the scope hereof.

For example, catheters are formed of various diameters. Likewise, marker bands are formed of various diameters. Therefore, in order to swage a particular marker band onto a selected catheter, a die is used that is specifically configured to accommodate the desired catheter and marker band. Accordingly, dies of varying sizes, including lengths, taper ratios, cavity diameters, etc. are all contemplated as being within the scope of the present invention.

Because the manufacture of catheters with marker bands must typically adhere to strict tolerances, the swaging machine 10, and particularly, the die cavity 190, should also conform to strict tolerances. In one embodiment, the swaging machine is configured to provide a high precision of swaged parts with repeatable accuracy of about ±0.0002 inches. Accordingly, the methods and structure recited in many of the disclosed embodiments are aimed at providing a high degree of accuracy. In other embodiments requiring less accuracy, the swaging machine embodiments described herein, along with the subsystems and components, can still be utilized to provide the desired results.

One embodiment of the disclosed die 130 provides for easy assembly and disassembly with no tools required. The assembled die 130 is quickly mounted to the swivel plate 134 by providing line up pins 162 that appropriately position the die 130 and then a single bolt 136 holds the die 130 in place as illustrated in FIG. 8. The die 130 is configured for long life due to the minimal wear of the die components. The selected materials require little or no lubrication and allow for smooth reciprocation of the impact plate 146.

During use, a marker band is slip fitted over a catheter, and the assembly is then inserted into the clamp 60 of the feed system 20. The feed system 20 feeds the catheter and marker band into the die cavity 190 within the die 130. The impact plate 146 is caused to reciprocate to open and close the die cavity 190, thus imparting a swaging force onto the marker band. Initially, the marker band is located within the tapered portion 192 of the die cavity 190, and thus, has its diameter gradually reduced in response to the swaging force imparted by the impact plate 146.

As the marker band and catheter are gradually fed through the die cavity 190 in a feeding direction, the die cavity tapers thereby further reducing the maker band diameter in response to the swaging force. Once the marker band has been fed completely through the tapered portion 192 of the die, the marker band then is fed through the cylindrical portion 194 of the die cavity 190, which promotes a substantially uniform finished diameter and surface finish of the marker band.

In order to apply a sufficient swaging force to the marker band, an appropriate impact force is applied to the impact plate 146. With returning reference to FIGS. 7 and 8, an impact hammer 132 supplies the necessary force to oscillate the impact plate between its second position and its first position, as described above.

As shown in FIGS. 7 and 8, the impact hammer 132 is positioned above the impact plate 146 and is configured to apply an impact force to the impact plate 146. In one embodiment, the impact hammer 132 is formed of heat treated steel and is driven by a pneumatic cylinder 200. A supply of compressed air to the air cylinder 200 is provided by one or more electronically controlled, fast acting solenoid valves 206 (FIG. 2). In some preferred embodiments, a pair of solenoid valves 206 are used for driving the hammer, which typically have a response time that is shorter than a single larger solenoid valve having the same air flow capacity. In general, the smaller the size and the flow capacity of the solenoid valve, the faster its response time is. Since the high hammering frequency is more desirable in some embodiments for the swaging process, a plurality of small capacity solenoid valves with very fast response times connected in parallel is often preferred to a single larger solenoid valve. In one embodiment, a pair of solenoid valves, each having a response time of about 4 ms, are used. In other embodiments, 4 or 6 solenoid valves, connected in parallel, are used to drive the impact hammer air cylinder 200.

Figure 14:
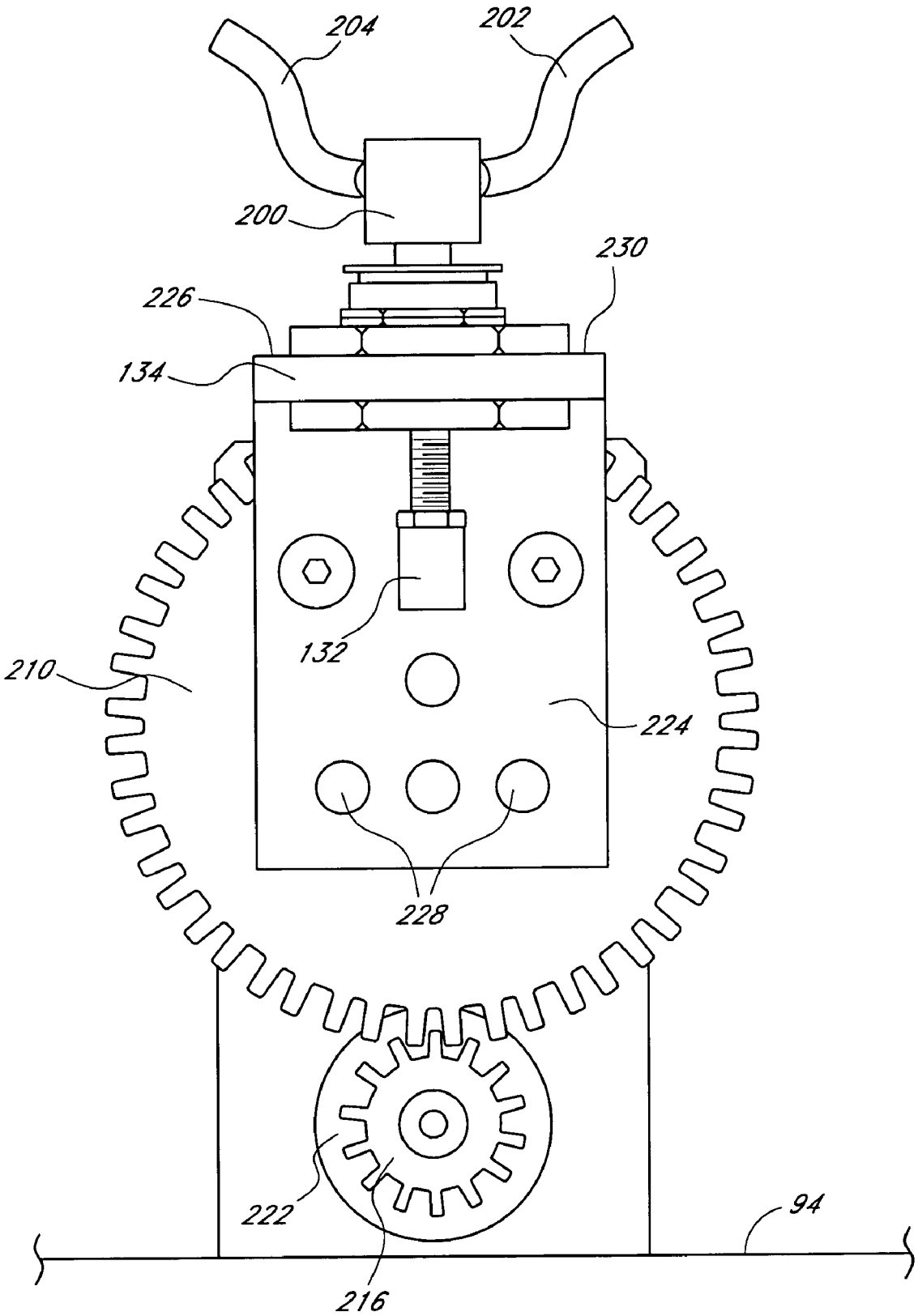
FIG. 14 is a front elevational view of the rotation system and impact system of a swaging machine.

As illustrated in FIGS. 7 and 14, the impact hammer 132 extends from a pneumatic cylinder 200. The cylinder 200 is in communication with a first and second pneumatic hose 202, 204 that deliver compressed air to the interior of the cylinder 200. The cylinder 200 further comprises a piston (not shown) configured for reciprocation therein, thereby separating the cylinder 200 into two chambers; a downstroke chamber and an upstroke chamber.

When the first hose 202 delivers compressed air to the downstroke chamber, the piston is forced to move downwardly within the cylinder 200. The impact hammer is connected to the cylinder 200 such that movement of the piston causes corresponding movement of the impact hammer 132. Thus, the impact hammer 132 is forced to move downwardly along with the piston. The terms "downwardly" or "power stroke" as used herein describe a direction that cause the hammer 132 to move away from the cylinder 200 and substantially toward the die 130. Conversely, the terms "upwardly" or "return stroke" describe a direction that causes the hammer 132 to move substantially toward the cylinder 200 and away from the die 130.

Upon completion of the power stroke, the second hose 204 delivers compressed air to the cylinder 200, which causes the piston and hammer 132 to be driven through the return stroke. The hoses 202, 204 are preferably configured to deliver compressed air sequentially, rather than simultaneously. Additionally, pressure relief valves can be provided to allow compressed air to escape the appropriate cylinder chamber as the piston reciprocates.

In an alternative embodiment, the return stroke is accomplished by a spring (not shown) within the cylinder 200. Thus, one or more solenoid valves 206 can be configured to supply compressed air for the power stroke, and once the air pressure is less than the spring force, the spring displaces the piston through its return stroke. Yet in other embodiments, both a spring force and air pressure are used to effect the return stroke to increase the maximum cycle frequency of the impact hammer.

In the illustrated embodiment, the hammer 132 is forced through its power stroke where it impacts the impact plate 146, and then the return stroke brings the hammer 132 to its initial position thereby completing an impact cycle. In one preferred embodiment, a pair of solenoid valves 206 are under the control of the control system 50 and open and close to deliver compressed air to the cylinder 200 at the appropriate time.

The impact cycle can be further controlled to increase part throughput by increasing the impact frequency, which is the number of impacts per a given time period. For example, an impact force within the range of from about 5 lbf to about 100 lbf is typically required to effect swaging. The appropriate impact force can be accomplished by varying the mass of the hammer 132 and/or the impact velocity at which it strikes the impact plate 146. Therefore, either the hammer mass, or the air pressure within the pneumatic cylinder 200, can be configured to supply the appropriate force. As will be apparent, different marker bands can be formed of different materials and have different wall thicknesses, which therefore require different impact forces to effect swaging.

It is preferred that the swaging machine of the preferred embodiments is capable of swaging marker bands of different sizes and materials, therefore it is more economical and efficient to provide a single hammer 132 with a predetermined mass, and then vary the pneumatic cylinder 200 operating conditions to apply an appropriate impact force to the impact plate 146.

Therefore, in one exemplifying embodiment, the impact hammer 132 is formed of heat treated steel that has been treated to a hardness of about 64 HRC, and has a mass of about 6 grams. It will be apparent to one of ordinary skill in the light of the disclosure herein that impact hammers 132 of various materials, hardness, weight, and density, can be successfully implemented into the present invention without departing from the scope hereof.

With a known hammer mass, the cylinder 200 can be configured to provide the required hammer velocity to impart a desired impact force. In one embodiment, the air pressure delivered to the cylinder is controlled to provide the necessary impact force. For example, air pressure within the range of from about 60 psi to about 120 psi, or more will deliver impact forces within one desired range of about 5 lbf to about 30 lbf.

Of course, more robust swaging can be accomplished by increasing the air pressure. Accordingly, an optional pressure booster (not shown) can be provided, either internally or externally to the swaging machine. The pressure booster can be configured to provide air pressure up to 150 psi in some embodiments, 200 psi in other embodiments, or more. Moreover, the pressure booster can be configured to provide air pressure within the range of from about 60 psi to about 100 psi where compressed air within that pressure range is not otherwise available. Alternatively, the magnitude of the swaging force can be either increased or decreased by configuring the system with either a larger or smaller sized air cylinder 200.

The pneumatic cylinder 200 is connected to the air supply by air hoses 202, 204, as described. Because the air hoses 202, 204 and the rest of the supply circuit contain certain compressible dead space volume and certain flow resistance, the supply circuit will exhibit resistive/capacitive behavior ("circuit RC constant"). As the pressure is relieved from the first hose 202 and applied to the second hose 204 to effect reciprocation of the piston and hammer 132, the capacitance from the first hose 202 continues to apply a force to the piston within the cylinder. This force on the piston due to capacitance reduces the maximum piston reciprocation cycle frequency. It is preferable that the piston is freely slidable within the cylinder to allow a fast impact frequency. The capacitance from the first hose 202 will tend to reduce the maximum frequency at which the piston can reciprocate because it opposes the desired motion of the piston.

One way to reduce the circuit RC constant is to use a hose formed of a material exhibiting a low stretchability. One embodiment utilizes hoses formed from a low elasticity material, such as nylon or relatively high durometer polyurethane, for example. Another way to reduce the circuit RC constant is to use a hose with a relatively short length and carefully selected diameter, as the hose capacitance increases with hose length and by the square power of hose diameter.

On the other hand, the hose flow resistance increases with hose length and decreases by the fourth power of increasing hose diameter. Due to the complexity of the problem under dynamic flow conditions, optimum hose size and length has been established empirically, and those empirical results utilized to select the above-described hosing. Moreover, it is preferable to minimize any sharp bends or kinks in the hose which will also adversely affect the cycle frequency by introducing additional friction and resistance into the pneumatic system. Therefore, the pneumatic hoses 202, 204 are preferably routed along a relatively smooth and direct path from the solenoid valves 206 to the cylinder 200.

The impact cycle frequency is an important factor in determining the part throughput of the Swaging Machine. The marker band will typically require a minimum number of impacts at the appropriate locations around the circumference and along the length of the marker band to result in a finished work piece. Accordingly, by increasing the frequency of the impacts, the finished work piece is created faster. However, the hammering frequency is limited, in part, by the mass of the hammer. Moreover, the frequency is further limited by the required swaging force and the available air pressure deliverable to the cylinder.

Of course, these variables can be changed to result in various desired swaging strategies. By varying the impact frequency, hammer mass, and air pressure, various swaging strategies become possible. For example, certain modes, such as a lower frequency and larger impact force are desirable when swaging marker bands having relatively thick walls, where a smaller impact force and higher impact frequency may be desirable for thin-walled marker bands, or when swaging onto delicate catheters. Therefore, in some embodiments, the impact frequency is user-selectable to result in a variety of swaging modes, as will be discussed in greater detail hereinafter. In some embodiments, the swaging frequency is variable within the range of from about 1 Hz to about 40 Hz.

Certain types of marker bands and catheters may require a larger impact force than others. In addition, many catheters, for example PTCA catheters, are formed of thin wall polymer tubes which can be collapsed by the marker band in response to the swaging process. Accordingly, it can be advantageous to use a mandrel within the catheter to inhibit such conditions. However, since a catheter will typically narrow in diameter when receiving a marker band, to prevent the mandrel from being locked into the catheter, a loose-fitting mandrel can be used to facilitate withdrawal of the mandrel after the swaging is complete. Of course, on larger diameter, heavy-walled tubing, a tight fitting mandrel can be used because the heavy walled catheter tubing will have a reduced tendency to narrow during swaging. However, rather than attempting to control the inner diameter of the finished work piece with a mandrel, some disclosed die embodiments have been designed to control the ID of the catheter and a mandrel is not required, which further increases part throughput capacity by reducing the number of manufacturing steps.

During the swaging process, the hammer 132 repeatedly impacts the impact plate 146 which, in turn, strikes and deforms the marker band. However, as discussed above, it is preferable that the marker band's outer diameter is reduced substantially uniformly. Accordingly, the impact of the impact plate 146 is dispersed along the length and around the circumference of the marker band. As described above, the feed system 20 gradually feeds the catheter and marker band through the die 130, which allows the impact forces to arrive at various locations along the length of the marker band. A rotation system 40 is provided for delivering impact forces around the circumference of the marker band.

In order to vary the impact around the circumference of the marker band, either the marker band and catheter, or the die 130 and hammer 132, or both, can be rotated around the longitudinal axis of the work piece. In the illustrated embodiment, the rotation system 30 is configured to rotate the die 130 and hammer 132 around the longitudinal axis of the catheter and marker band thereby providing swaging forces in various locations around the circumference of the marker band.

Figure 15:
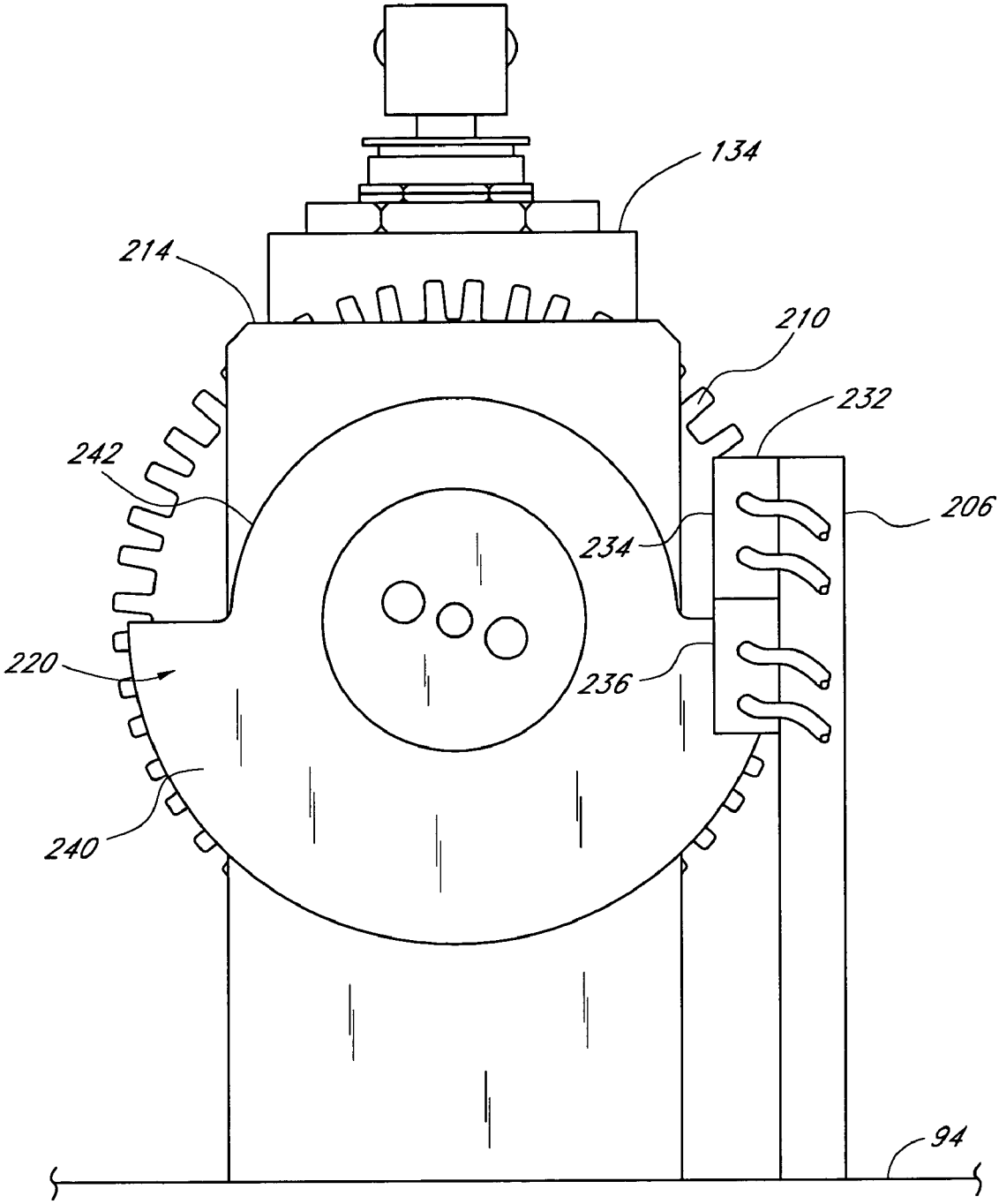
FIG. 15 is a rear elevational view of the rotation system of a swaging machine.

With reference to FIGS. 7, 14 and 15, the rotation system 40 comprises a swivel plate 134 which is attached to the face of a spur gear 210. The spur gear 210 is attached to one end of a hollow gear shaft 212 (FIG. 7), which extends through a base 214 and is rotationally mounted therein. The rotational support of the gear shaft 212 by the base 214 can be accomplished through any suitable mechanism, but in one embodiment, is configured for low friction rotation, such as through the use of ball bearings supported by the base 214. The gear shaft 212 further carries a timing cam 220 on its opposite end. A rotation motor 222 (FIG. 7) is mounted to the base 214 and includes a pinion gear 216 mounted to its output shaft in meshed connection with the spur gear 210. Thus, the base 214 provides a static mounting point for the rotation motor 222, and further provides a rotational coupling for the gear shaft 212 and attached spur gear 210 and timing cam 220.

The swivel plate 134 is substantially L-shaped in cross section with a first leg 224 mounted to the exposed face of the spur gear 210 and a second leg 226 extending perpendicular to the first leg 224. The first leg 224 is configured with one or more holes 228 to accept the mounting pins of the die 130 and the mounting bolt 136 used to secure the die 130 to the swivel plate 134. The die 130 is mounted to the swivel plate 134 such that the longitudinal axis of the die cavity 190 is coaxial with the gear shaft 212 axis. The second leg 226 of the swivel plate extends substantially orthogonally to the first leg 224 and provides a mounting platform 230 for the impact hammer 132 with accompanying components. Accordingly, the perpendicular nature of the swivel plate legs 224, 226 orients the cylinder 200 and hammer 132 to be substantially perpendicular and adjacent to the impact plate 146 of the die 130. Accordingly, upon actuation, the hammer 132 will strike the impact plate 146.

The rotation motor 222 is under the control of the control system 50, as will be described in greater detail below. As described, the rotation motor 222 output is transmitted through the pinion gear 216 and to the spur gear 210. Accordingly, the spur gear 210, with accompanying timing cam 220 and swivel plate 134 rotates about the gear shaft 212 axis. As described above in relation to FIG. 7, the die 130 and hammer 132 are connected to the swivel plate 134, and therefore rotate concurrently about the gear shaft 212 axis. The gear shaft 212 axis is coaxial with the catheter and marker band axes, and therefore, the die 130 rotates about the common catheter and marker band axes.

The rotation motor 222 is configured for bi-directional rotational output. Accordingly, the spur gear 216 is caused to rotate bi-directionally. Thus, the components connected to the spur gear 210, such as the swivel plate 134, hammer 132, and die 130, also rotate bi-directionally about the gear shaft 212 axis.

As described above according to one preferred embodiment, the impact plate 146 of the die 130 is biased away from the anvil 140. Additionally, the swaging cavity 190 is configured to allow easy removal of the work piece, such as by forming a radius on the edges of the die cavity. Thus, during operation, as the impact cycle causes the hammer 132 to repeatedly impact the impact plate 146, the impact plate 146 is forced downwardly, thus capturing the work piece within the die cavity 190 and imparting a swaging force thereto causing the marker band to conform to the shape of the die cavity 190. As the hammer 132 retracts, the impact plate 146 is biased away from the anvil 140 by the coil springs, thus separating the impact plate 146 and the anvil 140 thereby opening the die cavity 190 and releasing the work piece, at which time, the die 130 is able to rotate about the axis of the work piece. Additionally, during this period of die separation, the work piece can be fed further into the die cavity 190. Preferably, the feed system 20 is configured to incrementally feed the work piece during the periods of die separation, as will be discussed in greater detail below.

As the die 130 moves between the separated state in which the impact plate 146 is not in surface contact with the anvil 140, the work piece is freed from the constraints of the die cavity 190. As the impact plate 146 receives an impact from the hammer 132 and is forced toward the anvil 140, the work piece is captured within the die cavity 190 and is urged to conform to the die cavity 190 shape. Thus, the split nature of the die 130 imparts simultaneous swaging forces from both the impact plate 146 and the anvil 140 from opposing radial sides of the work piece. Accordingly, in order to apply a swaging force to the entire circumference of the marker band, the hammer 132 need only impact the impact plate 146 throughout a 180 degree range about the work piece. For example, assuming that a swaging force is applied over a very small surface of the marker band for each impact of the hammer 132, when the hammer 132 is oriented at an initial position, such as 0 degrees, the hammer 132 impact will apply a swaging force to the marker band at both an orientation corresponding with 0 degrees and 180 degrees simultaneously. Therefore, by rotating the hammer 132 and die 130 about the axis of the marker band throughout a 180 degree range of motion, the entire circumference of the marker band will receive a swaging force.

Therefore, in one preferred embodiment, the rotation motor 222 is configured to rotate bi-directionally over a travel range of about 180 degrees. Correspondingly, the swivel plate 134, die 130, and hammer 132 will also rotate concurrently through a 180 degree range of motion about the work piece. Thus, the swaging force applied to the marker band as a result of the die 130 compressing in response to the hammer 132 impact will be applied about the entire circumference of the marker band.

A regular distribution of the swaging force about the circumference of the marker band can lead to undesirable results. For example, during the swaging process, the marker band is cold worked and plastically deforms in response to the swaging force. Accordingly, the marker band changes shape as it is swaged to conform to the shape of the die cavity 190. Moreover, as the die 130 revolves throughout a 180 degree range of motion, it will dwell at its travel limit positions due to deceleration and acceleration times resulting from the momentum of the rotation system 40. Thus, if the rotation system 40 rotates smoothly between its travel limits and the impact forces are distributed regularly over a given time period, a greater number of impacts will be applied when the rotation system 40 is close to its travel limits. Therefore, the accumulation of swaging forces at specific angular orientations will cause the marker band to be undesirably out-of-round.

To alleviate this undesirable result, certain preferred embodiments evenly distribute the swaging forces around the circumference of the marker band. In one embodiment, this is accomplished by randomizing the travel of the rotation system 40. For example, rather than allowing the rotation system to oscillate between its full 180 degree travel limits, the rotation system 40 is controlled such that it reverses direction at random angular orientations. In one embodiment, the random angular displacement of the rotation system 40 is controlled by the control system 50. In this embodiment, the impact hammer 132 can be configured to provide a constant cycle frequency that will be randomly distributed about the circumference of the marker band.

According to another embodiment, the impact hammer 132 cycle is controlled to provide random impacts over time. Accordingly, as the rotation system 40 oscillates through its maximum angular displacement, the impact hammer 132 applies random impacts about the circumference of the work piece.

In yet another embodiment, the rotation system 40 is configured to rotate through a full 360 degree orientation. In this embodiment, the impact system 30 can continuously rotate around the work piece, thus providing swaging forces evenly around the circumference of the work piece. However, this embodiment requires modifications to the pneumatics to prevent the hoses 202, 204 from becoming tangled around the rotation system 50. For example, a slip ring can be mounted to the rotation system 50 and configured with a static portion that accepts the input from the pneumatic hoses 202, 204, and a revolving portion in communication with the static portion and in further communication with the impact cylinder 200. Thus, the pneumatic hoses 202, 204 do not rotate with the rotation system 50, yet the air pressure supplied by the hoses 202, 204 is delivered through the slip ring and to the impact cylinder 200.

An embodiment utilizing continuous rotation can time the impact system 30 to distribute impact forces evenly about the circumference of the work piece, according to various swaging strategies. For example, if the impact forces are applied at angular orientations that are evenly dividable into 360, then the impact forces will be applied to the work piece at substantially the same angular orientations during subsequent revolutions. For the remainder of this description, an angular orientation of 0 degrees assumes that the impact hammer 132 is generally vertical and above the die 130. If the impact forces are applied at every 3 degrees, such as 3, 6, 9, 12 degrees and so on, then 120 impacts will be applied to the work piece, and the impact system 30 will reapply impact forces to the same locations during subsequent revolutions. However, if the impact forces are timed to be applied to the work piece at angular orientations that are not dividable into 360, then the impact forces will be applied around substantially the entire circumference of the work piece. For example, by applying an impact force at every 7 degrees, then the impact force will not be applied at the same orientation twice for seven revolutions and only after each integer angular orientation has received an impact force. Rather, the impact force will be applied at angular orientations of 7, 14, and 21 degrees during a first revolution, and then at 4, 11, and 18 degrees during the second revolution, and so on.

In some preferred embodiments, the maximum angular displacement of the rotation system 40 is limited to 180 degrees. In these embodiments, the rotation motor 222 is controlled by the control system 50. The control system 50 receives a signal indicating when the rotation system 40 is at its travel limit, and appropriately controls the motor 222 to reverse its operating direction. This signal is provided by an opto-electronic sensor 232. As shown in FIG. 15, an opto-electronic sensor 232 ("sensor") is mounted to the deck 94 adjacent to the timing cam 220. The timing cam 220 is mounted on the second end of the gear shaft 212 and thus rotates with the rotation system 40. The sensor 232 is configured with a light emitting component 234, such as a light emitting diode (LED) or a photo transistor that emits light or other suitable component. The sensor 232 is further configured with a light sensor 236 that detects a state of reflection of the emitted light off the timing cam 220. Therefore, when the sensor 232 detects the reflected light, it outputs a first signal to the control system 50, and when the sensor 232 does not detect the reflected light, it outputs a second signal to the control system 50.

The timing cam is configured with a first feedback portion and a second feedback portion that provide at least two signal states of the sensor. In the illustrated embodiment, the timing cam has a first semi-circular portion 240 having a first radius, and a second semi-circular portion 242 having a second radius. The sensor 232 is mounted to the deck 94 in a location such that as the timing cam 220 rotates on the gear shaft 212, the light will be reflected by the first semi-circular portion 240, but not by the second semi-circular portion 242. Accordingly, during rotation of the timing cam 220, as the first semi-circular portion 240 reflects the light, the sensor 232 sends a first signal to the control system 50 which causes the motor 222 to turn in a first direction until the timing cam 220 rotates through a predetermined angular displacement and the timing cam 220 second semi-circular portion 242 is adjacent the sensor 232 and does not reflect the light. When the timing cam 220 is in this position and does not reflect the light, the sensor 232 sends a second signal to the control system 50 which reverses the direction of the rotation motor 222 and causes it to turn in a second direction.

Once the control system 50 signals the motor 222 to reverse direction, the motor 222 must decelerate, momentarily stop, and then accelerate again before the rotation system 40 begins rotating in the opposite direction. Inertia within the rotation system 40 causes the rotation system 40 to continue for about 90 degrees during deceleration before the rotation system 40 stops rotating and begins accelerating in the opposite direction. Accordingly, the separation between the first and second semi-circular portions 240, 242 of the timing cam 220 is located about 90 degrees out of phase with the angular orientation of the hammer 132.

For example, as illustrated in FIG. 15, the sensor 232 senses the separation between the first and second semi-circular portions 240, 242 when the hammer is at 0 degrees. At this time, the sensor 232 changes its signal output to the control system 50, which instructs the motor 222 to reverse direction. However, inertia continues to rotate the rotation system 40 an additional 90 degrees before the rotation system 40 direction is reversed.

Thus, the timing cam 220 and sensor 232 provide feedback to the control system 50 and indicate when the rotation system 40 is approaching the desired angular travel limit. Accordingly, the control system 50 can reverse the direction of the motor 222 such that it oscillates back and forth through a 180 degree travel limit. As discussed above, one preferred embodiment of the rotation system 40 includes a control system 50 that randomly reverses the direction of the motor 222 at various angular displacements. In these embodiments, the timing cam 220 and sensor 232 provide feedback to the control system 50 to limit, and not necessarily control, the maximum angular displacement of the rotation system 40.

The disclosed configuration and operation of the rotation system 40 is exemplifying of one preferred embodiment. Other embodiments will be readily apparent to those of ordinary skill in the art in light of the disclosure herein. For example, the timing cam 220 need not have the specific shape described, but can be formed to have any suitable shape that provides the desired rotation characteristics. Moreover, the timing cam 220 can be characterized such that a portion of it does not reflect light, such as by providing a surface texture or light absorbing surface covering. Alternatively, other types of sensors can be used to provide feedback about the angular orientation of the rotation system. Additionally, the timing cam 220 and sensor 232 may be omitted and the control system 50 can control the angular displacement of the rotation system 40 independently.

The control system 50 is configured to control the various machine systems according to user selectable operation variables. Notably, the control system 50 is responsible for (1) controlling the delivery of compressed air to both the feed system 20 and the impact system 30; (2) driving the feed motor 100 according to a desired feed strategy, including the feed screw 62 travel limit; and (3) randomizing the angular displacement of the rotation system 40 and sensing the angular displacement limits. The control system 50 receives electricity, such as from a power supply mounted within a housing 250, which it distributes to the feed system 20, impact system 30, and rotation system 40, as necessary.

The control system 50 features user selectable parameters, which in one embodiment, as illustrated in FIG. 1, are in the form of dials 252 located on the front surface of the housing 250. In one embodiment, dials 252 are provided for allowing a user to control the air pressure, hammer frequency, and feed rate control.

According to one control strategy, air pressures between about 50 psi and 100 psi are desired to drive the impact hammer 132. Accordingly, the control system 50 accepts user input to control the compressed air at a desired compression. In one embodiment, this is accomplished by limit valves that regulate the air pressure being delivered to the impact system 30. According to another control strategy, higher pressures, such as up to about 150 psi may be desired. Accordingly, the control system 50 accepts the user input and can control the pressure booster to increase the pressure of the air being delivered to the impact hammer 132.

In one embodiment, the pressure booster is a cylinder containing a known volume of air and further comprises a piston for sliding into the cylinder thereby compressing the contained air to a desired pressure. Of course, other types of air compressors may be used with the described system, and may be internal or external to the housing 250.

The control system 50 further accepts user input to control the impact cycle frequency. For example, according to one control strategy, a user may desire to set the impact cycle frequency for fast part throughput, and may thus desire a relatively high cycle frequency, such as about 20 to 30 Hz, or more. According to other control strategies, a user may set a relatively low cycle frequency, such as between about 2 and 15 Hz.

Additionally, a user control is provided to allow a user to set a desire feed rate. For example, a user can selectively input a feed rate of between about 0.5 mm per second and about 6.8 mm per second. Additionally, some embodiments allow a user to set the spacing between multiple marker bands on a single catheter. Thus, by setting the proper location of a first marker band, knowing the length of each marker band, and knowing the distance between multiple marker bands, the control system can feed the first marker band through the swaging die 130 at the selected feed rate, and can then rapid feed to the start of the next marker band. The rapid feed increases part throughput while providing for a fully automated process once the appropriate parameters are input to the control system 50.

Additionally, the control system 50 is configured to control the feed motor 100 at an appropriate time to coordinate with the impact system 30 such that the work piece is fed into the die 130 only during instances of die separation. Accordingly, the feed motor 100 incrementally feeds the work piece into the die 130 at the desire feed rate.

Typically, the control strategy variables are balanced to result in a work piece having the desired characteristics. For example, in order to have a larger impact force, which may be required to swage thicker-walled marker bands, the impact hammer 132 air pressure can be increased and the impact cycle frequency can be reduced. Moreover, the marker band surface finish is controlled, in large part, by the feed rate through the die 130. Therefore, in order to produce a swaged marker band having a smooth surface finish, a slower feed rate is preferable. Accordingly, the impact pressure, impact frequency, and feed rates are all predetermined to result in a desired control strategy resulting in a marker band having a desired surface finish and being produced in a desired amount of time.

To use the swaging machine thus described, a user selectively applies power to the machine, such as be activating a power button 254 (FIG. 1) or switch, and the machine 10 is initialized. During machine initialization, the clamp 60 is opened and retracted by the feed system 20, and the hammer 132 is retracted. The user places a catheter with one or more snuggly fitting marker bands between the open jaws 64, 66 of the clamp 60 and allows it to rest in the guide trough 72. The user inserts the catheter into the feed hole 150 in the front plate 142 of the die until the first marker band is adjacent the feed hole 150 opening. In some embodiments, a light source, such as an LED, can be appropriately positioned to illuminate the die feed hole 150 to aid the user with the insertion of the catheter into the die cavity 140. With an appropriately selected die 130, the catheter will easily slide through the opened die 130.

The user sets the clamp pressure and can then instruct the machine 10 to close the jaws 62, 64, thereby securely holding the work piece. The user sets the control variables, such as swaging pressure, hammer frequency, distance between multiple marker bands, and feed rate.

The user begins the swaging cycle, such as by depressing a foot pedal, and the control system 50 activates the rotation system 40, feed system 20, and impact system 30. As described above, the feed system 20 is preferably timed to feed the work piece through the die 130 only during moments of die separation. The control system 50 continues feeding the work piece through the die 130 as the rotation system 40 and impact system 30 applies swaging forces around the circumference of the work piece and the length of the marker band. In particular combinations of marker bands and catheters, the entire swaging can take as little as 10 seconds or less to complete the swaging process while still producing an acceptable quality finished part.

As the impact system 30 forcefully and repeatedly opens and closes the die 130, the die 130 deforms the marker band such that its diameter is reduced and it becomes attached to the catheter. The die cavity 140 geometry gradually reduces the marker band diameter as it is fed through the die cavity tapered portion 192. As the marker band exits the die cavity tapered portion 192, it is fed through the die cavity cylindrical portion 194 which improves the surface finish and uniformity of the swaged marker band. The catheter and marker band are fed through the die 130 until the entire marker band exits the die cavity 190.

Notably, the rotation system 40 and impact system 30 provide an open path along the longitudinal axis of the catheter to allow the catheter to extend from the feed system 20 through the impact system 30 and rotation system 40. Accordingly, the spur gear 210 and timing cam 220 each have an axial hole formed therethrough to allow passage of the catheter. As previously described, the gear shaft 212 supporting the spur gear 210 and timing cam 220 is hollow to allow passage of the catheter. Thus, the guide trough 72 provides a guide which positions the catheter and marker band to be substantially coaxial with the axis of the die swaging cavity 190, which is also coaxial with the gear shaft 212 axis. However, it is not necessary that the guide trough 72 align the catheter exactly coaxial with the die cavity 190 axis because the catheter is typically flexible and will flex over its unsupported length between the guide trough 72 and the die 130 to result in acceptable alignment with the die cavity 190.

For those catheters requiring multiple marker bands swaged thereto, once a marker band is completely fed through the die 130, the control system 50 can instruct the feed system 20 to rapid feed the catheter up to the next marker band thereby increasing the part throughput and allowing for an automated process.

Upon complete swaging of all marker bands onto a catheter, the swaging machine returns to its initial position with the hammer 132 retracted, the feed system retracted, and the clamp 60 is then opened to allow removal of the work piece from the die 130.

Figure 16:
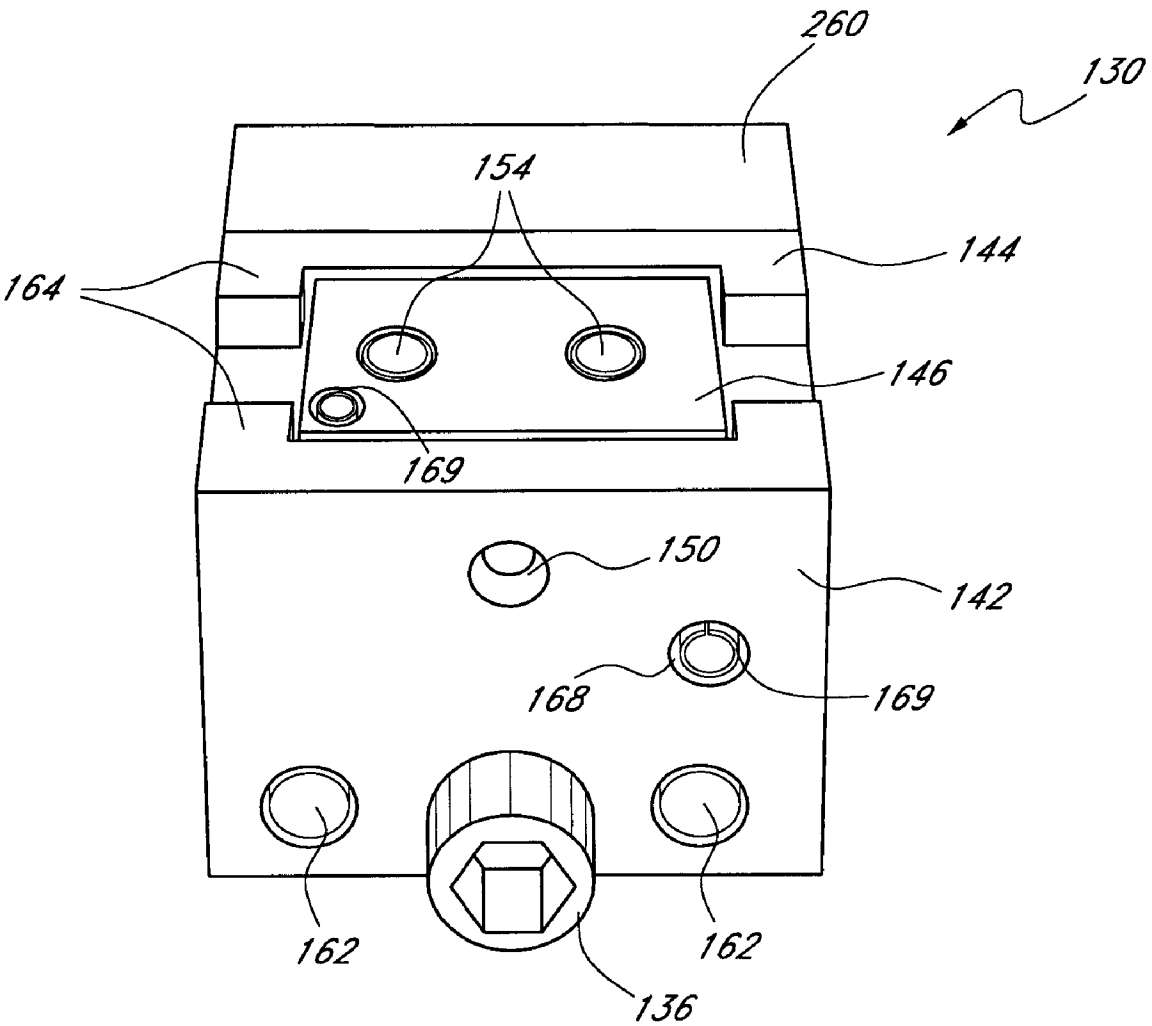
FIG. 16 is a front perspective view of another embodiment of a die for use with a swaging machine.
Figure 17:
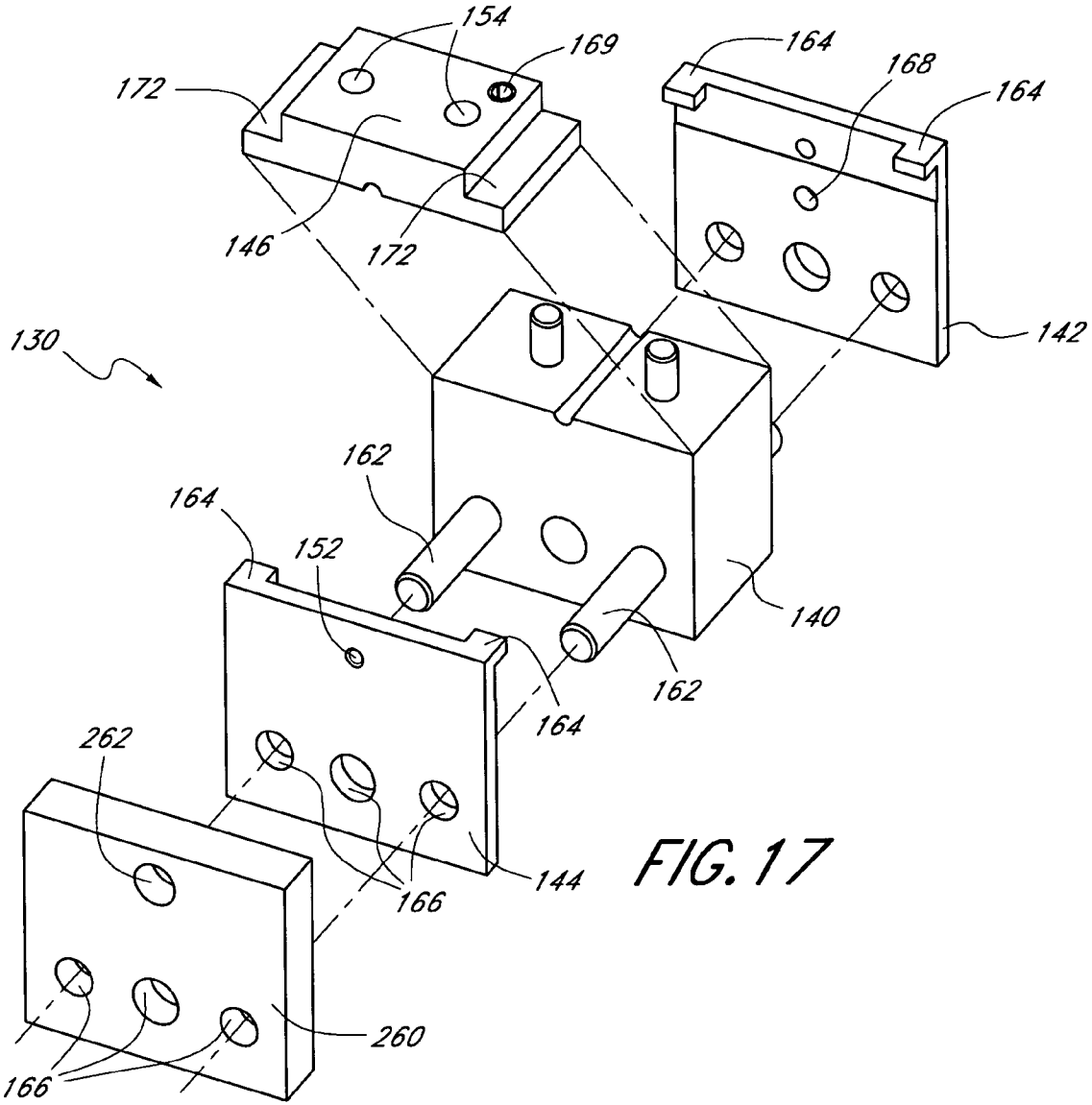
FIG. 17 is an exploded view of the die of FIG. 16.

With reference to FIGS. 16 and 17, alternative embodiments of a die 130 are shown. This illustrated embodiment incorporates a relatively short die cavity. Accordingly, the overall length of the die 130 is reduced. This particular embodiment includes an anvil 140, a front plate 142, a rear plate 144, an impact plate 146, and a spacer plate 260. It's manufacture and assembly is substantially the same as the die 130 described above and illustrated in FIGS. 8–11, with the exception of the added spacer plate 260

With outer dimensional changes in the die 130, once the die 130 is mounted to the swivel plate 134, the relative location of the impact hammer 132 should be taken into consideration. For example, by varying the outer dimensions of the die 130, the relative position of the impact hammer 132 to the impact plate 146 can be misaligned. It is preferable that the impact hammer 132 line up adjacent with the approximate center of the impact plate 146, and accordingly, the spacer plate 260 appropriately positions the impact plate 146 to receive an impact force to the approximate center of the impact plate 146.

The anvil 140 is configured with one or more alignment pins 154 that are received into corresponding holes formed in the impact plate 146. As described above, there are one or more coil springs disposed between the anvil 140 and the impact plate 146 to supply a biasing force to the impact plate 146 such that the impact plate 146 is biased away from the anvil 140. The anvil 140 additionally includes a line-up pin 169 configured for slidable insertion into a corresponding line-up hole formed in the impact plate 146. The front plate 142 includes a feed hole 150 advantageously chamfered or tapered to provide a lead-in funnel for the work piece. The front plate 142 further includes mounting holes 166 to assemble the front plate 142 to the anvil 140 and to further allow passage of a threaded fastener to allow the assembled die 130 to be mounted to the swivel plate 134, as described above. The front plate 142 may also be configured with a line-up hole 168 corresponding to a line-up pin 169 protruding from the front face of the anvil 140 to facilitate proper alignment and positioning of the front plate 142 onto the front face of the anvil 140.

The rear plate 144 includes mounting holes 166 configured to correspond with the mounting pins 162 of the anvil 140 and to allow passage of a threaded fastener 136 to facilitate mounting of the assemble die 130 onto the swivel plate 134.

The spacer plate 260 is substantially a solid plate that corresponds with the perimeter dimension of the rear plate 144 and includes mounting holes 166 to accept the mounting pins 162 of the anvil 140 as well as a threaded fastener to allow mounting of the assembled die 130 onto the swivel plate. The spacer plate 260 additionally includes a work piece hole 262 to allow unobstructed passage of the work piece through the spacer plate. The spacer plate 260 is advantageously configured with an appropriate width dimension that positions the approximate center of the impact plate 146 away from the swivel plate 134 to correspond with the impact hammer 132. Thus, the spacer plate 260 accounts for the reduced longitudinal dimension of the die 130 and allows appropriate positioning of the impact plate 146 relative to the impact hammer 132.

The illustrated dies 130 are yet other embodiments of a die 130 suitable for use with the described swaging machine. It will be apparent to those of ordinary skill in light of the disclosure herein that other suitable die 130 embodiments are possible depending upon the selected marker band and/or catheter. For example, dies 130 having impact plates 146 configured with a different mass will provide varying results to the one described. Alternative or additional structure can be incorporated to bias the upper plate 146 away from the anvil 140, such as, without limitation, air pressure, resilient spacers, or a biased hinge connecting the two components along one of their respective edges. Additionally, the swaging cavities can take alternative shapes, including without limitation, varying taper angles, lengths, and diameters. Thus, by choosing an appropriate die 130, the disclosed swaging machine is able to swage a wide variety of marker bands onto a wide variety of catheters.

Figure 18:
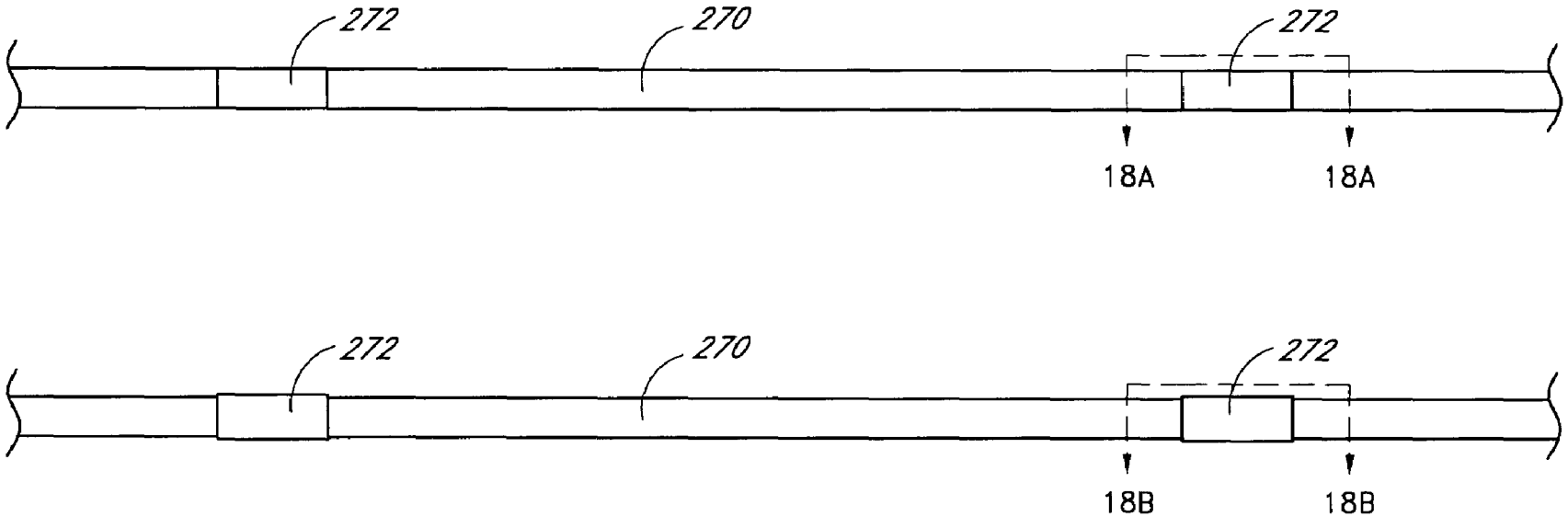
FIGS. 18, 18A, and 18B illustrate examples of typical catheters having one or more marker bands swaged thereon.

FIG. 18 illustrates examples of catheters and marker bands following the swaging process. As discussed above, the catheter 270 is an elongate hollow body typically formed of any of a number of polymers. The marker bands 272 are generally formed of a radiopaque material, such as gold, platinum, or iridium. The marker bands 272 initially have an ID that is larger than the catheter OD and the marker bands 272 can slide over the catheter to their desired position. In the case where the marker bands 272 are able to loosely slide over the catheter 270, the marker bands 272 may initially be slightly crimped, such as by crimping pliers, to temporarily fix the marker band 272 to the catheter 270 until the swaging process can be performed.

Figure 18B:
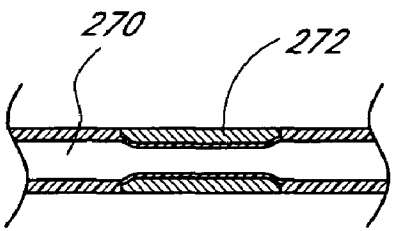
Figure 18A:
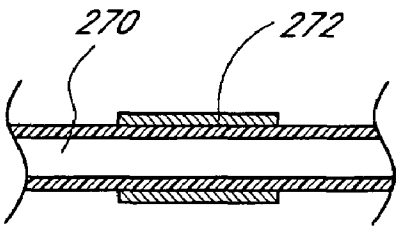

The marker bands 272 are malleable and can be reduced in size radially to form a secure attachment through surface friction with the catheter 270. The disclosed swaging machine embodiments produce the illustrated result of the marker band 272 in surface engagement with the catheter. In some embodiments, the marker band 272 OD is larger than the catheter 270 OD such as in FIG. 18A. In other embodiments, the marker band is substantially embedded into the catheter material such that the marker band 272 OD is substantially equal to the catheter 270 OD as in FIG. 18B. As discussed above, the surface finish of the marker band 272 is a large indicator of the quality of the finished part and is a determining factor in the integrity of the marker band 272 and catheter 270. Accordingly, the swaged marker bands are subject to visual and instrumental inspection. While a typical visual inspection utilizes a 40× magnification, more rigorous instrument inspection, such as by a scanning laser gauge or laser mic, has shown that the roundness of the swaged marker bands produced by the disclosed apparatus and methods can be as precise as 0.0002 inches.

While the foregoing description describes apparatus and methods for swaging a marker band onto a catheter as illustrative, one of ordinary skill will realize that the description can be applicable to other devices, such as, for example, joining sleeves. A joining sleeve is typically a thin-walled tubular part generally formed of a malleable metal such as 300 Series stainless steel, for example. A joining sleeve is commonly used to join microcatheters or other medical devices. The parts to be joined can be in the form of tubes, wires, coils, or any combination of suitable materials having a generally circular cross section. Exemplary joining sleeves can be as small as about 0.008 inches in OD or smaller and can have a length as small as 0.040 inches or smaller.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above.

What is claimed is:

1. A swaging machine configured to swage a marker band onto a catheter, comprising:

a feed system comprising a motor and a clamp, the clamp slideably disposed on a rail, the motor in driving engagement with the clamp and configured for transmitting a feeding force to the clamp, the motor being operatively coupled to a feed screw, the feed screw having a coupled end connected to the clamp, the motor configured to drive the feed screw and the clamp linearly, the feed system further comprising a damping coupling between the feed screw and the clamp;

an impact system comprising a hammer and a die, the hammer configured to deliver an impact to the die, the die configured to distribute the impact force as a swaging force to the marker band; and a rotation system comprising a motor and configured to rotate the impact system to distribute the swaging force about a circumference of the marker band.

2. The swaging machine of claim 1, wherein the damping coupling is configured to allow restricted movement of the feed screw to align itself with the motor.

3. The swaging machine of claim 1, wherein the damping coupling is formed of polyurethane tubing.

4. A swaging machine configured to swage a marker band onto a catheter, comprising:

a feed system comprising a motor and a clamp, the clamp slideably disposed on a rail, the motor in driving engagement with the clamp and configured for transmitting a feeding force to the clamp, the clamp comprising a first jaw and a second jaw configured for relative displacement to open and close the clamp, the feed system further comprising a pneumatic cylinder having a pair of compressed air supply hoses, an internal piston, and a piston rod connected to the clamp;

an impact system comprising a hammer and a die, the hammer configured to deliver an impact to the die, the die configured to distribute the impact force as a swaging force to the marker band; and a rotation system comprising a motor and configured to rotate the impact system to distribute the swaging force about a circumference of the marker band.

5. The swaging machine of claim 4, wherein the cylinder piston rod translates an actuation force to at least one jaw of the clamp.

6. The swaging machine of claim 5, further comprising a coupling interconnecting the first jaw to a second jaw and configured to translate an actuation force thereto.

7. The swaging machine of claim 6, wherein the coupling comprises a lever having a midpoint rotatably mounted to a base and slidingly engages each of the first jaw and second jaw.

8. A swaging machine configured to swage a marker band onto a catheter, comprising:

a feed system comprising a motor and a clamp, the clamp slideably disposed on a rail, the motor in driving engagement with the clamp and configured for transmitting a feeding force to the clamp;

an impact system comprising a hammer and a die, the hammer configured to deliver an impact to the die, the die configured to distribute the impact force as a swaging force to the marker band, the hammer comprising a pneumatic cylinder having one or more delivery hoses coupled thereto, an internal piston moveable through a powerstroke and a return stroke, and a piston rod extending from the piston to the exterior of the cylinder; and a rotation system comprising a motor and configured to rotate the impact system to distribute the swaging force about a circumference of the marker band.

9. The swaging machine of claim 8, wherein the piston rod carries a mass configured to deliver an impact.

10. The swaging machine of claim 9, wherein the one or more delivery hoses supply compressed air to the cylinder to drive the piston and piston rod through the powerstroke.

11. The swaging machine of claim 10, wherein the piston is caused to move through its return stroke by a biasing member.

12. The swaging machine of claim 10, wherein the piston is caused to move through its return stroke by a pneumatic cylinder.

13. A swaging machine configured to swage a marker band onto a catheter, comprising:

a feed system comprising a motor and a clamp, the clamp slideably disposed on a rail, the motor in driving engagement with the clamp and configured for transmitting a feeding force to the clamp;

an impact system comprising a hammer and a die, the hammer configured to deliver an impact to the die, the die configured to distribute the impact force as a swaging force to the marker band; and a rotation system comprising a motor and configured to rotate the impact system to distribute the swaging force about a circumference of the marker band, the rotation system further comprising a rotation limiter for limiting the angular displacement of the rotation system.

14. The swaging machine of claim 13, wherein the rotation limiter comprises an indicator, a sensor, and a signal output generator.

15. The swaging machine of claim 14, wherein the indicator is a timing cam, the sensor senses at least two states of the timing cam corresponding with the angular orientation of the timing cam, and the signal output generator sends a signal to a control system corresponding with the state of the cam.

16. The swaging machine of claim 13, wherein the rotation limiter limits angular displacement of the rotation system to 180 degrees.

17. The swaging machine of claim 13, wherein the angular displacement is limited by a control system.

* * * * *